US007547014B2

(12) United States Patent
Okuda et al.

(10) Patent No.: US 7,547,014 B2
(45) Date of Patent: Jun. 16, 2009

(54) RECORDING MATERIAL GUIDING DEVICE AND RECORDING APPARATUS

(75) Inventors: Yasumichi Okuda, Nagano (JP); Yoshihiro Kobayashi, Nagano (JP); Kazuhito Hori, Nagano (JP); Naohiro Ueyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 399 days.

(21) Appl. No.: 11/237,205

(22) Filed: Sep. 27, 2005

(65) Prior Publication Data

US 2006/0071388 A1 Apr. 6, 2006

(30) Foreign Application Priority Data

Sep. 27, 2004 (JP) ..... 2004-280743

(51) Int. Cl.
*B65H 1/00* (2006.01)

(52) U.S. Cl. ..... 271/171; 271/162; 271/147; 271/145; 399/377; 347/104

(58) Field of Classification Search ..... 271/171, 271/162, 147, 145; 347/104; 399/377
See application file for complete search history.

(56) References Cited

U.S. PATENT DOCUMENTS 4,509,738 A * 4/1985 Aoki ..... 271/160
5,411,248 A 5/1995 Yamaguchi
5,713,570 A 2/1998 Ouchi
2002/0167124 A1* 11/2002 Hanabusa ..... 271/125
2002/0167125 A1* 11/2002 Nakamura ..... 271/171
2003/0127364 A1 7/2003 Salomon

FOREIGN PATENT DOCUMENTS

| | | |
|---|---|---|
| EP | 0 950 531 A1 | 10/1999 |
| JP | 5-12428 | 2/1993 |
| JP | 8-143169 | 6/1996 |
| JP | 3092370 | 12/2002 |

OTHER PUBLICATIONS

Extended European Search Report dated Dec. 4, 2006.

* cited by examiner

*Primary Examiner*—Patrick H Mackey
*Assistant Examiner*—Luis Gonzalez
(74) *Attorney, Agent, or Firm*—Edwards Angell Palmer & Dodge LLP; John J. Penny, Jr.

(57) ABSTRACT

In a recording material guiding device, a second guide member 606 is comprised of a hopper swinging surface 23*c*, an edge guide member 25 including a second side end guide member 25*a*, and a liftup preventing guide 251. The hopper swinging surface 23*c* is engaged in an opening provided in a side surface of a reference end guide 24 serving as a first guide member 603. The second guide member 606 can be slid in a main scanning direction with respect to the reference end guide 24 (first guide member 603). During recording a gap d1 can be formed between the second side end guide member 25*a* and a side end Pa of the recording paper P by sliding the second side end guide member 25*a* from a first position 604 to a second position 605, so that frictional contact can be prevented at the side end Pa of the recording paper P on the second side end guide member side.

8 Claims, 18 Drawing Sheets

RECORDING MATERIAL GUIDING DEVICE AND RECORDING APPARATUS

BACKGROUND OF THE INVENTION

The present invention relates to a recording material guiding device for preventing frictional contact between a recording material and a recording material guiding member by displacing the recording material guiding member during recording, as well as a recording apparatus having the same.

Conventionally, after paper is set, a user guides a paper guide by moving the paper guide to a side end of the paper, so that there have been variations in the gap between the side end of the paper and the paper guide. For this reason, if the gap is large, the paper is skewed during paper feeding, and there are possibilities of the occurrence of a paper jam or a skew of the print on the paper. In a case where the aforementioned gap is small the frictional resistance between the paper and the paper guide becomes large, so that the paper becomes difficult to be fed, and there has been a possibility of causing a decline in the recording quality.

Accordingly, in JP-UM-A-5-12428, a paper guide of an automatic feeder is provided with a limiter mechanism. The limiter mechanism sets a fixed gap between each side end of the stacked paper and the paper guide on each side when the paper is set. By virtue of this gap, it is possible to reduce the frictional force between the paper and the paper guide.

However, if a fixed guide is always set, there is a possibility of a variation occurring in the main scanning direction due to the vibration during recording and the friction between the sheets of paper. Accordingly, there is a possibility of the paper coming into contact with the paper guide during recording, resulting in the occurrence of friction. Namely, since the friction hereafter referred to as the back tension) during recording is only reduced, the image quality can possibly decline in the case of A3 or the like having a large paper since in which the back tension is likely to occur.

Accordingly, the present invention has been devised in view of such problems, and its object is to provide a recording material guiding device which sets friction to nil instead of reducing the friction at least between one side end of the recording material and a side end guiding member during recording, as well as a recording apparatus having the recording material guiding device.

SUMMARY OF THE INVENTION

To attain the above object, in accordance with a first aspect of the invention there is provided a recording material guiding device comprising: a feed tray in which a recording maternal is stacked; a first side end guiding member and a second side end guide member for restricting the movement of the recoding material in a main scanning direction; and a hopper having the first side end guiding member and the second side end guide member and capable of causing the stacked recording material to be brought into contact with and move away from a feed roller so as to transport the stacked recording material to the feed roller, wherein the hopper has frictional contact preventing means for preventing frictional contact at least between one side end of the recording material and one of the first side end guiding member and the second side end guide member.

According to the first aspect of the invention, since the recording material guiding device has the frictional contact preventing means, it is possible to prevent frictional contact at least between one side end of the recording material and one of the first side end guiding member and the second side end guide member. Namely, back tension can be set to nil at least at one side end of the recording material. Accordingly, it is possible to improve the recording image quality since back tension can be reduced remarkably even in the case of the large A3 or the like having a large paper size in which the back tension is likely to occur.

According to a second aspect of the invention, in the first aspect, the recording material guiding device is characterized in that the frictional contact preventing means is comprised of: a first guide member which has the first side end guiding member and whose sliding movement in the main scanning direction is restricted; and a second guide member which has the second side end guide member, and is slidable in the main scanning direction with respect to the first side end guiding member up to a first position and a second position, wherein the first position is a position where the second side end guide member and the one side end of the recording material abut, and the second position is a position for forming a gap between the second side end guide member and the one side end of the recording material.

According to the second aspect of the invention, in addition to an operational effect similar to that of the first aspect, since the hopper is comprised of the first guide member and the second guide member which is slidable in the main scanning direction with respect to the first guide member up to the first position and the second position, and a gap can be formed between the second side end guide member and the side end of the recording material, there is no possibility of frictional contact occurring at the side end of the recording material on the second side end guide member side.

According to a third aspect of the invention, in the second aspect, the recording material guiding device is characterized in that the frictional contact preventing means has a moving direction converting mechanism for converting a force for causing the hopper to be brought into contact with and move away from the feed roller into a force for causing the second guide member to slide in the main scanning direction.

According to the third aspect of the invention, in addition to an operational effect similar to that of the second aspect since the frictional contact preventing means has the moving direction converting mechanism, the force for causing the hopper to be brought into contact with and move away from the recording material can be converted into the force for causing the second guide member to slide in the main scanning direction. Accordingly, by causing the hopper to move toward and away from the feed roller (hereafter, this motion will be referred to as the swinging motion), the second guide member can be slid to the first position or the second position.

In addition, since it is possible to make use of the power source for swinging the hopper toward the feed roller, a new power source is not required.

According to a fourth aspect of the invention, in the third aspect, the recording material guiding device is characterized in that the moving direction converting mechanism has a guide projection provided on the second guide member and a guide groove provided in the feed tray and adapted to engage the guide projection.

According to the fourth aspect of the invention, in addition to an operational effect similar to that of the third aspect, the moving direction converting mechanism can be constructed simply by merely providing the guide projection on the second guide member and the guide groove in the feed tray for engagement with the guide projection.

According to a fifth aspect of the invention, in the fourth aspect, the recording material guiding device is characterized in that the guide groove includes: a rectilinear portion provided on a side of the feed roller and extending in the same direction as a direction in which the hopper is brought into contact with and moves away from the feed roller; and an inclined portion provided on a side away from the feed roller and inclined with respect to the rectilinear portion.

According to the fifth aspect of the invention, in addition to an operational effect similar to that of the fourth aspect, since the guide groove has the rectilinear portion and the inclined portion, it is possible to control the sliding motion of the second guide member in the main scanning direction on the basis of one cycle of the swinging motion of the hopper toward the feed roller.

Furthermore, since the guide groove has the rectilinear portion on the feed roller side and the inclined portion on the side away from the feed roller, there is no possibility of hampering the pressing of the recording material against the feed roller, which is the essential operational effect of the hopper.

According to a sixth aspect of the invention, in any one of the second to fifth aspects, the recording material guiding device is characterized in that the second guide member has a guide member control portion for providing control such that when the second guide member is at the second position, the second guide member slides from the second position to the first position until ensuing recording material to be recorded is fed.

According to the sixth aspect of the invention, in addition to an operational effect similar to that of any one of the second to fifth aspects, since the second guide member has the guide member control portion, the second guide member can be slid from the second position to the first position until the ensuing recording material to be recorded is fed. Namely, the second side end guide member and the side end of the stacked recording material assume their original state of abutting against each other. Accordingly, in the case where the ensuing recording material (stacked recording material) has offset in the main scanning direction due to the aforementioned gap during recording, the second side end guide member is capable of pushing back the side end of the offset recording material to rearrange the side end of the recording material until the next feeding.

According to a seventh aspect of the invention, in the sixth aspect, the recording material guiding device is characterized in that the guide member control portion has a throughput control unit which provides control such that when a rear end in a transporting direction of the recording material is fed from the hopper to a downstream side, the second guide member slides from the second position to the first position.

According to the seventh aspect of the invention, in addition to an operational effect similar to that of any one of the second to fifth aspects, since the throughput control unit is provided, when the rear end in the transporting direction of the recording material is fed from the hopper to the downstream side, the second guide member can be moved from the second position to the first position. Namely, regardless of whether or not recording is being effected, the second guide member can be returned to the first position to prepare for the feeding of the ensuing recording material. In other words, since the second guide member is returned to the first position at an early timing, it is possible to improve the throughput.

According to an eighth aspect of the invention, in the seventh aspect, the recording material guiding device is characterized in that the throughput control unit has a recording material detector provided on the downstream side of the hopper to detect the rear end of the recording material.

According to the eighth aspect of the invention, in addition to an operational effect similar to that of the seventh aspect, since the recording material detector is provided, it is possible to reliably detect that the rear end of the recording material has been transported to the downstream side from the hopper.

According to a ninth aspect of the invention, in any one of the second to eighth aspects, the recording material guiding device is characterized by further comprising: a cam disposed coaxially with the feed roller to control the hopper, wherein the cam is provided with a projection which extends at least a length from the first position to the second position in the main scanning direction so as to abut against the second abutment portion at the second position.

According to the ninth aspect of the invention, in addition to an operational effect similar to that of any one of the second to eighth aspects, since the cam is provided with a projection which extends at least a length from the first position to the second position in the main scanning direction so as to abut against the second abutment portion at the second position, even if the second guide member is at the second position, control can be provided by the guide member control potion.

According to a 10th aspect of the invention, in any one of the second to ninth aspects, the recording material guiding device is characterized by further comprising: a liftup preventing guide disposed on the second side end guide member and adapted to prevent the lifting up of the stacked recording material, wherein the liftup preventing guide extends at least the length from the first position to the second position in the main scanning direction so as to be capable of abutting against a surface of the stacked recording material even if the second guide member is at the second position.

According to the 10th aspect of the invention, in addition to an operational effect similar to that of any one of the second to ninth aspects, the liftup preventing guide extends at least the length from the first position to the second position in the main scanning direction so as to be capable of abutting against the surface of the stacked recording material even if the second guide member is at the second position. Accordingly, it is possible to prevent the lifting up of the recording material stacked on the feed tray even if the second guide member is at the second position.

According to an 11th aspect of the invention, in any one of the second to 10th aspects, the recording material guiding device is characterized in that the second guide member is arranged to slide to a third position after sliding to the second position, and the third position is a position which is displaced slightly from the first position toward a side of the recording material.

As described before, even in a case where the second guide member is returned from the second position to the first position, there is a possibility that the side ends of the randomly oriented sheets of recording material fail to be arranged neatly.

Therefore, according to the 11th aspect of the invention, in addition to an operational effect similar to that of any one of the second to 10th aspects, the second guide member is arranged to slide to the third position which is a position displaced slightly from the first position toward the side of the recording material. Accordingly, even in the case where the side ends of the stacked sheets of recording material are randomly oriented at the second position, the second guide member slides to the third position, thereby making it possible to neatly arrange the side ends of the randomly oriented sheets of recording material by pushing them in.

According to a 12th aspect of the invention, in any one of the second to 11th aspects, the recording material guiding device is characterized in that the feed roller is disposed in such a manner as to be offset toward the first side end guiding member, the retard roller further comprising: a transport roller extending in the main scanning direction on the downstream side in the transporting direction of the feed roller and forwardly and reversely rotatable to transport the recording material; and unskewing means which unskews the recording material before feeding by means of the feed roller and the transport roller.

According to the 12th aspect of the invention, in addition to an operational effect similar to that of any one of the second to 11th aspects, unskewing means is provided, and the unskewing means unskews the recording material before feeding by means of the feed roller disposed in such a manner as to offset toward the first side end guide member side and the transport roller extending in the main scanning direction on the downstream side in the transporting direction of the feed roller and forwardly and reversely rotatable to transport the recording material. Therefore, the recording material can be moved slightly toward the opposite side to the first side end guide member side, i.e., toward the second side end guide member side. Accordingly, since a gap is produced between the side end of the recording material and the first side end guide member, it is possible to prevent frictional contact. As a result, during recording, it is possible to prevent the frictional contact of the recording material on both sides of the first side end guide member and the second side end guide member.

According to a 13th aspect of the invention, there is provided a recording apparatus comprising: a feeding section for feeding a stacked recording material by holding the stacked recording material; a recording section for effecting recording on the recording material fed from the feeding section; and a discharge section for discharging the recording material from the recording section, wherein the feeding section has the recording material guiding device according to any one of claims 1 to 12.

According to the 13th aspect of the invention, in the recording apparatus it is possible to obtain an operational effect similar to that of any one of the second to 12th aspects.

The present disclosure relates to the subject matter contained in Japanese patent application No. 2004-280743 fed on Sep. 27, 2004, which is expressly incorporated herein by reference in its entirety.

DESCRIPTION OF THE PREFERRED EMBODIMENT

Hereafter, a description will be given of the embodiments of the invention with reference to the drawings.

Figure 1:
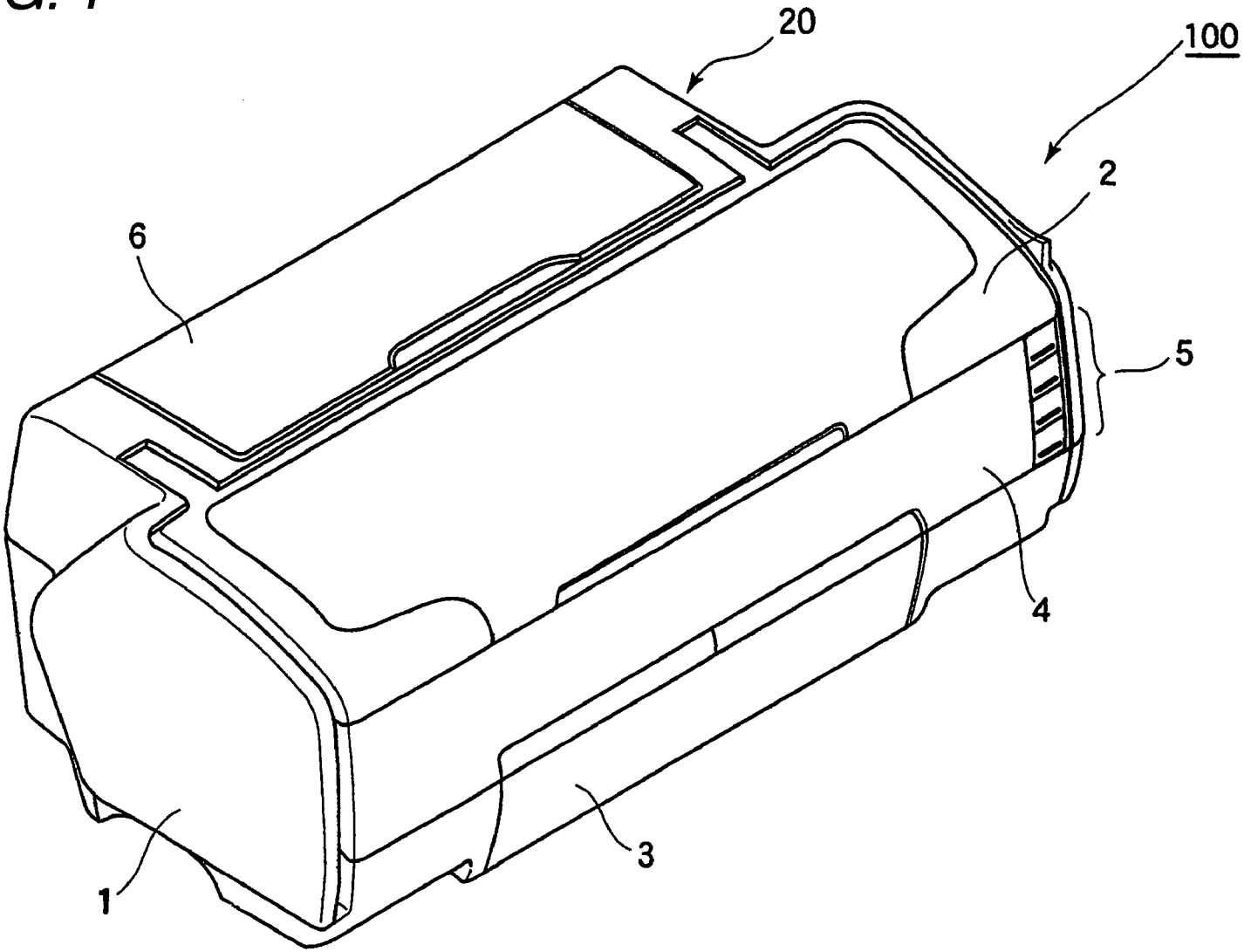
FIG. 1 is an external perspective view of an ink jet recording apparatus.
Figure 2:
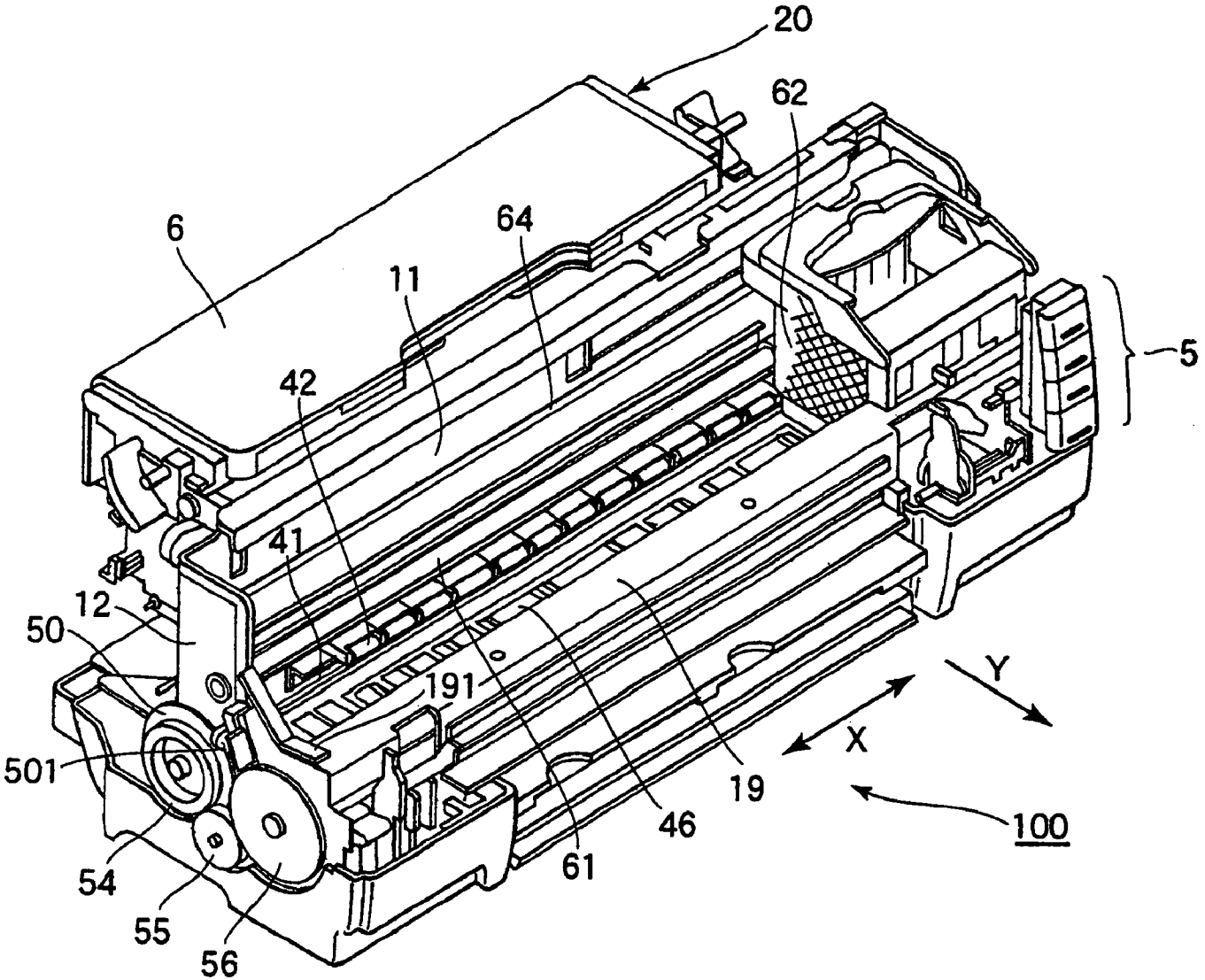
FIG. 2 is a schematic perspective view of the ink jet recording apparatus in a state in which its body cover is removed.
Figure 3:
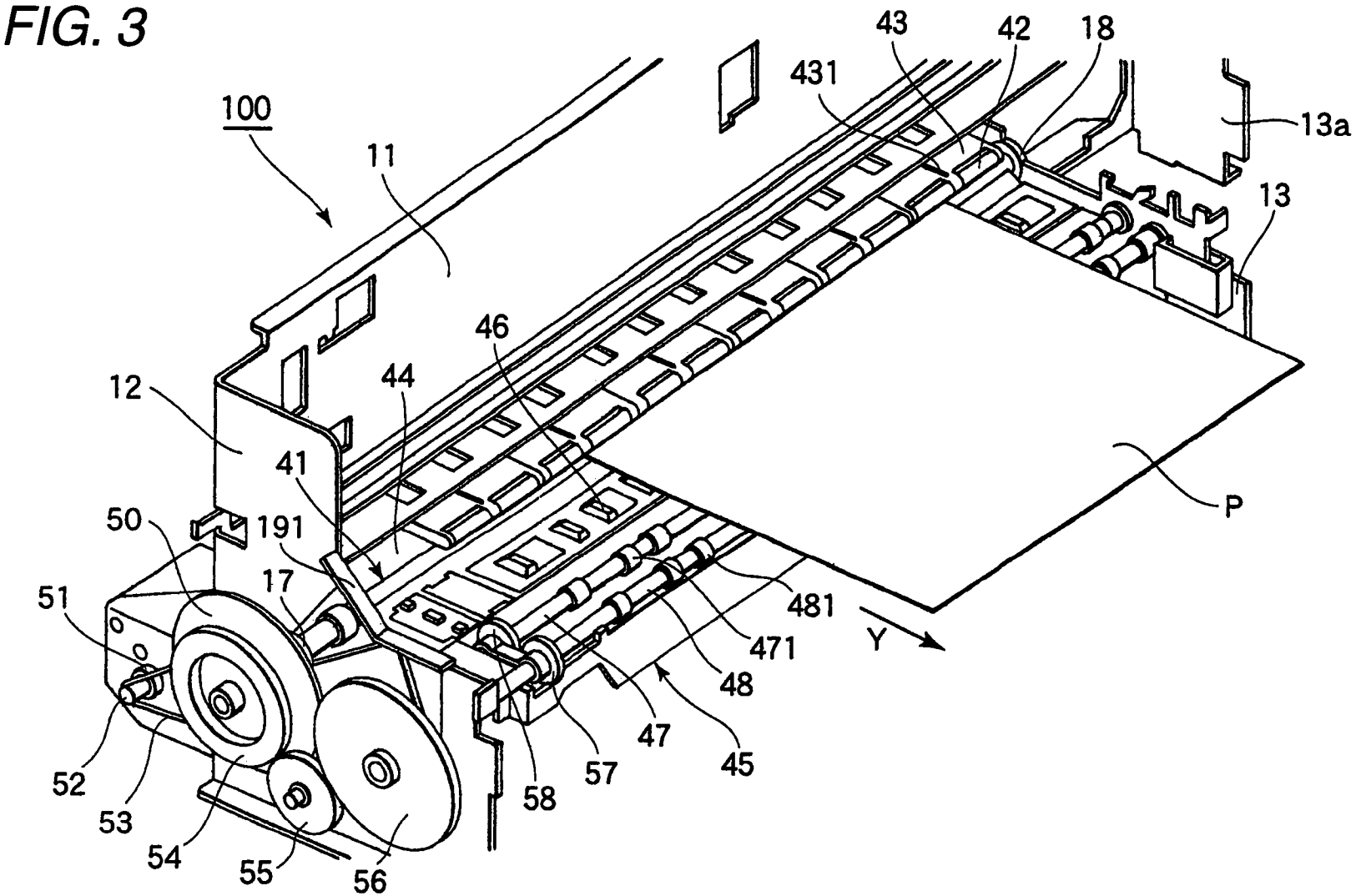
FIG. 3 is a perspective view of essential portions of the internal structure of the ink jet recording apparatus.
Figure 4:
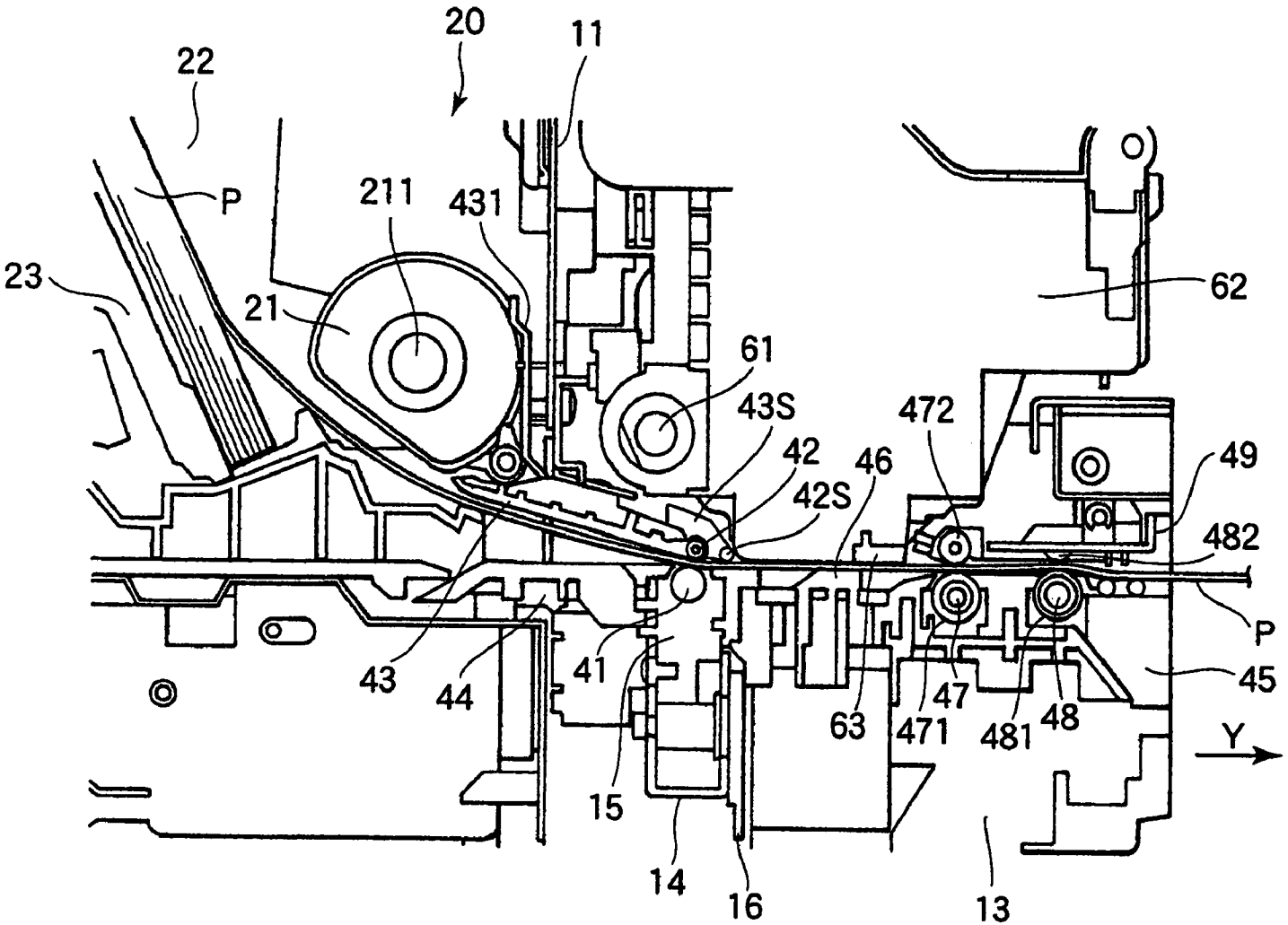
FIG. 4 is a side cross-sectional view of the essential portions of the internal structure of the ink jet recording apparatus.

FIG. 1 is an external perspective view of an ink-jet recording apparatus in accordance with the invention. FIG. 2 is a schematic perspective view of the ink jet recording apparatus in accordance with the invention in a state in which its body cover is removed. FIG. 3 is a perspective view of essential portions of the internal structure of the ink jet recording apparatus in accordance with the invention. FIG. 4 is a side cross-sectional view of the essential portions of the internal structure of the ink jet recording apparatus in accordance with the invention.

As shown in FIG. 1, an ink jet recording apparatus 100 is covered with a body cover 1, and a top cover 2 which can be opened and closed in the vertical direction is disposed on an upper surface of the body cover 1. A user is capable of accessing the interior of the ink jet recording apparatus 100 by opening the top cover 2 and is able to perform the replacement and the like of an ink cartridge. Switches 5 including a power switch are disposed on the front surface of the body cover 1, and a discharged paper stacker 3 and a tray cover 4 are disposed openably in the forward direction. When recording is executed, the discharged paper stacker 3 is used in a state of being forwardly open, and recording paper P serving as the "recording material" and the "transported material" after executing recording is discharged and stacked on the discharged paper stacker 3 in the open state. The tray cover 4 permits the user to access a tray insertion port for manual insertion of a disk tray from the front side. The disk tray is used is used to execute recording on the label surface of an optical recording disk. As the disk tray with the optical recording disk is manually inserted up to a predetermined insertion position in the tray insertion port to execute recording, it is possible to execute the recording on the label surface of the optical recording disk.

As shown in the drawing, an automatic feeder 20 is disposed in the rear of the ink jet recording apparatus 100, and an upwardly openable paper feed tray cover 6 is disposed in an upper portion of the automatic paper feeder 20. The paper feed tray cover 6 is used in an open state during the execution of recording, and the recording paper P before execution of recording is adapted to be stacked on a paper feed tray 22 forming a supporting surface for the recording paper P integrally with the paper feed tray cover 6 in the open state. The recording paper P stacked on the paper feed tray 22 is pressed against an outer peripheral surface of a paper feed roller 21 by a hopper 23 which swings toward the paper feed roller 21 side at a predetermined timing during paper feeding. The sheets of recording paper P pressed against the outer peripheral surface of the paper feed roller 21 are automatically fed one sheet at a time toward nips between an outer peripheral surface of a transport drive roller 41 and outer peripheral surfaces of transport driven rollers 42 by the rotative driving of the paper feed roller 21 disposed rotatably with a paper feed roller shaft 211 serving as a rotating shaft.

The main framework of a housing of the ink jet recording apparatus 100 is formed by a main frame 11, a left side frame 12, a right side frame 13, a right side outer frame 13*a*, and a rear frame 19. The left side frame 12 (through a member 191), the right side frame 13, and the right side outer frame 13*a* are connected by the rear frame 19 on the front side of the ink jet recording apparatus 100. Both ends of the transport drive roller 41 are respectively supported by the left side frame 12 and the right side frame 13 so as to be rotatable in the transporting direction (sub scanning direction Y) of the recording paper P. The left end of the transport drive roller 41 is rotatably supported by the left side frame 12 by means of a rotating bush 17, while the right end of the transport drive roller 41 is rotatably supported by the right side frame 13 by means of a rotating bush 18. In addition, a supporting portion formed in the vicinity of a center of the transport drive roller 41 is rotatably supported by an intermediate supporting member 15. The intermediate supporting member 15 is adapted to be capable of vertically moving a supporting position in the vicinity of the center of the transport drive roller 41 by the rotational position of an adjustment member 16 disposed rotatably on a sub frame 14. A high-friction resisting film is formed on that portion of the outer peripheral surface of the transport drive roller 41 where the recording paper P is pressed and brought in close contact, excluding the portion which is rotatably supported by the intermediate supporting member 15.

Two transport driven rollers 42 are supported in each transport driven roller holder 43 in such a manner as to be drivenly rotatable in the transporting direction of the recording paper P. The transport driven rollers 42 are disposed in such a manner as to be juxtaposed in parallel to the transport drive roller 41, and are respectively swingably supported by the main frame 11. Each transport driven roller holder 43 is pressed and urged against the transport drive roller 41 by a spring 431, with the result that each transport driven roller 42 is pressed against the outer peripheral surface of the transport drive roller 41 with a substantially fixed pressing force. In addition, auxiliary roller holders 43S are respectively disposed on the downstream side of the transport driven roller holders 43 in the sub scanning direction Y, and an auxiliary roller 42S is supported by each auxiliary roller holder 43S in such a manner as to be drivenly rotatable in the transporting direction of the recording paper P. The recording paper P which is fed from the automatic paper feeder 20 is guided toward the outer peripheral surface of the transport drive roller 41 by a paper guide front member 44, is nipped between the outer peripheral surface of the transport drive roller 41 and the outer peripheral surfaces of the transport driven rollers 42, and is pressed to be brought into close contact with the high-friction resisting film surface of the transport drive roller 41. As the transport drive roller 41 is rotated in the sub scanning direction Y, the recording paper P is transported in the sub scanning direction Y at a rate of transport corresponding to the amount of rotation of the transport drive roller 41.

A transport gear 54 is integrally attached to the transport drive roller 41 so as to be capable of transmitting the rotation, the rotative driving of a drive pulley 52 of a transport motor 51 (see FIG. 3) is transmitted to the transport gear 54 through an endless belt 58 to rotate the rotate the transport drive roller 41. The recording paper P which is transported in the sub scanning direction Y by the rotation of the transport drive roller 41 is transported while its planar attitude is bring restricted with its reverse surface brought into sliding contact with a platen 46 formed integrally with a paper guide rear member 45. It should be noted a known rotary encoder serving as a "rotation amount detecting means" for detecting the amount of rotation of the transport drive roller 41 is provided on the left end side of the transport drive roller 41. The rotary encoder has a rotary scale 50 which rotates in interlocking relation to the rotation of the transport drive roller 41, as well as a rotary scale sensor 501 for detecting slits formed at equal intervals along the outer periphery of the rotary scale 50.

The ink jet recording apparatus 100 has a carriage 62 for causing a recording head 63 for effecting recording by injecting ink to the recording paper P to scan the recording paper P in the main scanning direction X. The carriage 62 is pivotally supported by a carriage guide shaft 61 so as to be reciprocatable in the main scanning direction X, and reciprocates in the main scanning direction X as the rotatively driving force of an unillustrated carriage motor is transmitted thereto by an unillustrated belt transmission mechanism. The carriage guide shaft 61 is disposed with its both ends supported by the left side frame 12 and the right side outer frame 13*a*. An ink cartridge (not shown) in which inks of various colors are filled is detachably mounted on the carriage 62, and the inks of various colors are supplied from the ink cartridge to the recording head 63. The head surface of the recording head 63 reciprocates in the main scanning direction X at a position opposing the platen 46, and the inks are injected from nozzles arranged in the head surface of the recording paper P being transported on the platen 46, so as to execute recording. The gap between the head surface of the recording head 63 and the recording surface of the recording paper P is defined by the platen 46. In addition, a known linear encoder for detecting the moved position of the carriage 62 is disposed in the ink jet recording apparatus 100. The linear encoder has a linear scale 64 disposed in parallel to the carriage guide shaft 61 and a linear scale sensor (not shown) for detecting slits formed at equal intervals in the linear scale 64.

Meanwhile, as means for discharging the recording paper P after the execution of recording, a first paper exit drive roller shaft 47 and a second paper exit drive roller shaft 48, which are supported by the paper guide rear member 45 so as to be rotatable in the sub scanning direction Y, are disposed on the downstream side of the platen 46 in the sub scanning direction Y. As shown in the drawings, a plurality of fit paper exit drive rollers 471 are provided at substantially equal intervals on the first paper exit drive roller shaft 47, and a plurality of second paper exit drive rollers 481 are similarly provided at substantially equal intervals on the second paper exit drive roller shaft 48 as well. The second paper exit drive rollers 481 rotates in the discharging direction tub scanning direction Y) as the rotatively driving force of the transport motor 51 is transmitted to the second paper exit drive roller shaft 48 through the transport gear 54, an intermediate gear 55, and a paper exit gear 56. The first paper exit drive rollers 471 rotate in the discharging direction (sub scanning direction Y) as the rotatively driving force of the transport motor 51 is transmitted to a gear 58 attached to the first paper exit drive roller shaft 47, through a gear 57 attached to the second paper exit drive roller shaft 48 so as to be capable of transmitting rotation as well as an unillustrated intermediate gear.

A paper exit frame 49 (FIG. 4), which is elongated in the main scanning direction X, is provided on upper sides of the first paper exit drive roller shaft 47 and the second paper exit drive roller shaft 48. A plurality of first paper exit driven rollers 472 are supported by the paper discharge frame 49 at positions corresponding to the first paper exit drive rollers 471 in such a manner as to be drivenly rotatable. A plurality of second paper exit driven rollers 482 are supported thereby at positions corresponding to the second paper exit drive rollers 481 in such a manner as to be drivenly rotatable. The first paper exit driven rollers 472 and the second paper exit driven rollers 482 are toothed rollers which have a plurality of teeth around their peripheries and in which tips of the teeth are acutely pointed so as to come into point contact with the recording surface of the recording paper P. The first paper exit driven rollers 472 and the second paper exit driven rollers 482 are respectively urged against the first paper exit drive rollers 471 and the second paper exit drive rollers 481 with weak urging forces. The recording paper P after execution of recording is nipped between the first paper exit drive rollers 471 and the first paper exit driven rollers 472 and is transported by the rotation of the first paper exit drive rollers 471 in the discharging direction. Further, the recording paper P is nipped between the second paper exit drive rollers 481 and the second paper exit driven rollers 482 and is discharged onto the discharged paper stacker 3 in the open state as the second paper exit drive rollers 481 are rotated in the discharging direction.

In the ink jet recording apparatus having such a construction, the blank recording paper P before recording is first automatically fed by the automatic paper feeder 20. Subsequently, the operation in which the automatically fed blank recording paper P before recording is transported with a predetermined amount of transport in the sub scanning direction Y by the rotation of the transport drive roller 41 while coming into sliding contact with the platen 46 opposing the head surface of the recording head 68 and the operation in which ink is injected from the recording head 63 reciprocating over the platen 46 in the main scanning direction X are alternately executed repeatedly to execute recording on the recording surface. Then, the recording paper P after execution of recording is discharged onto the discharged paper stacker 3 in the open state by the rotation of the first paper exit drive rollers 471 and the first paper exit driven rollers 472 in the discharging direction. This series of recording execution operations is executed as an automatic paper feed motor (not shown) serving as a driving force source of the automatic paper feeder 20, the transport motor 51, and a carriage driving motor (not shown) are controlled by an unillustrated recording controller.

Figure 6:
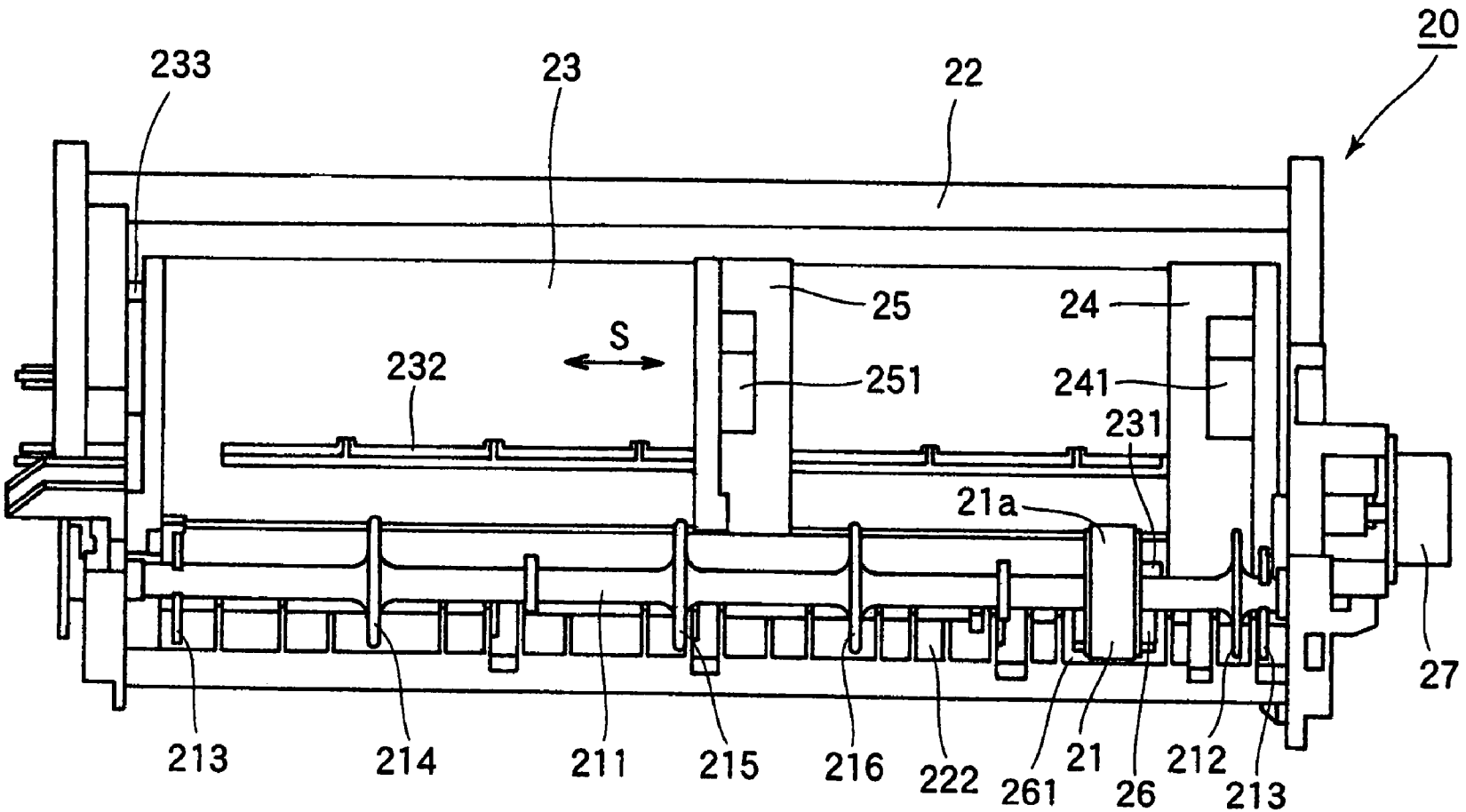
FIG. 6 is a front elevational view of the essential portions of the automatic paper feeder in accordance with the invention.
Figure 7:
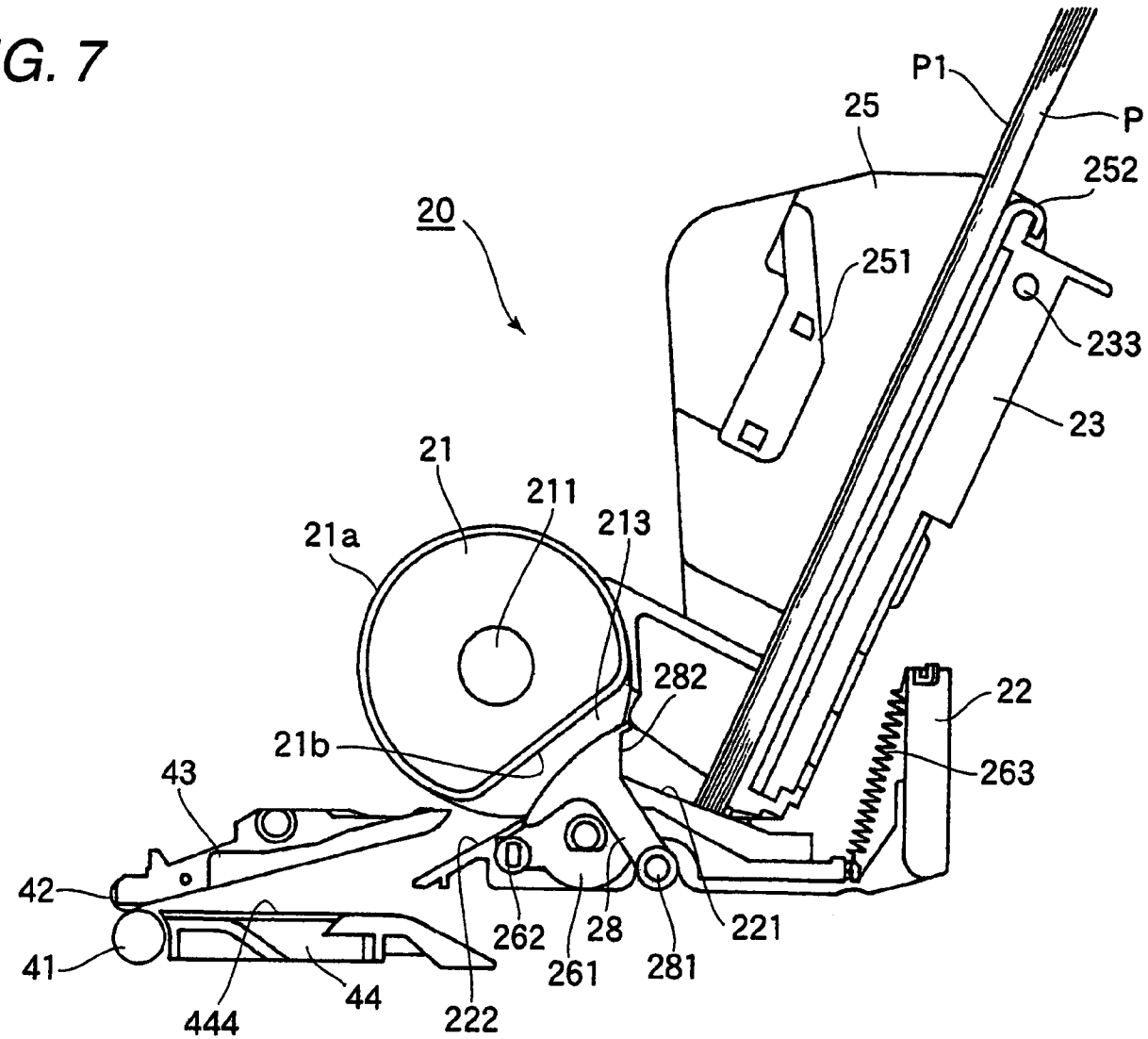
FIG. 7 is a side elevational view of the essential portions of the automatic paper feeder in accordance with the invention.

Next, referring to FIGS. 5 to 7, a description will be given of a schematic construction of the automatic paper feeder 20 serving as an "automatic feeding device" in accordance with the invention.

Figure 5:
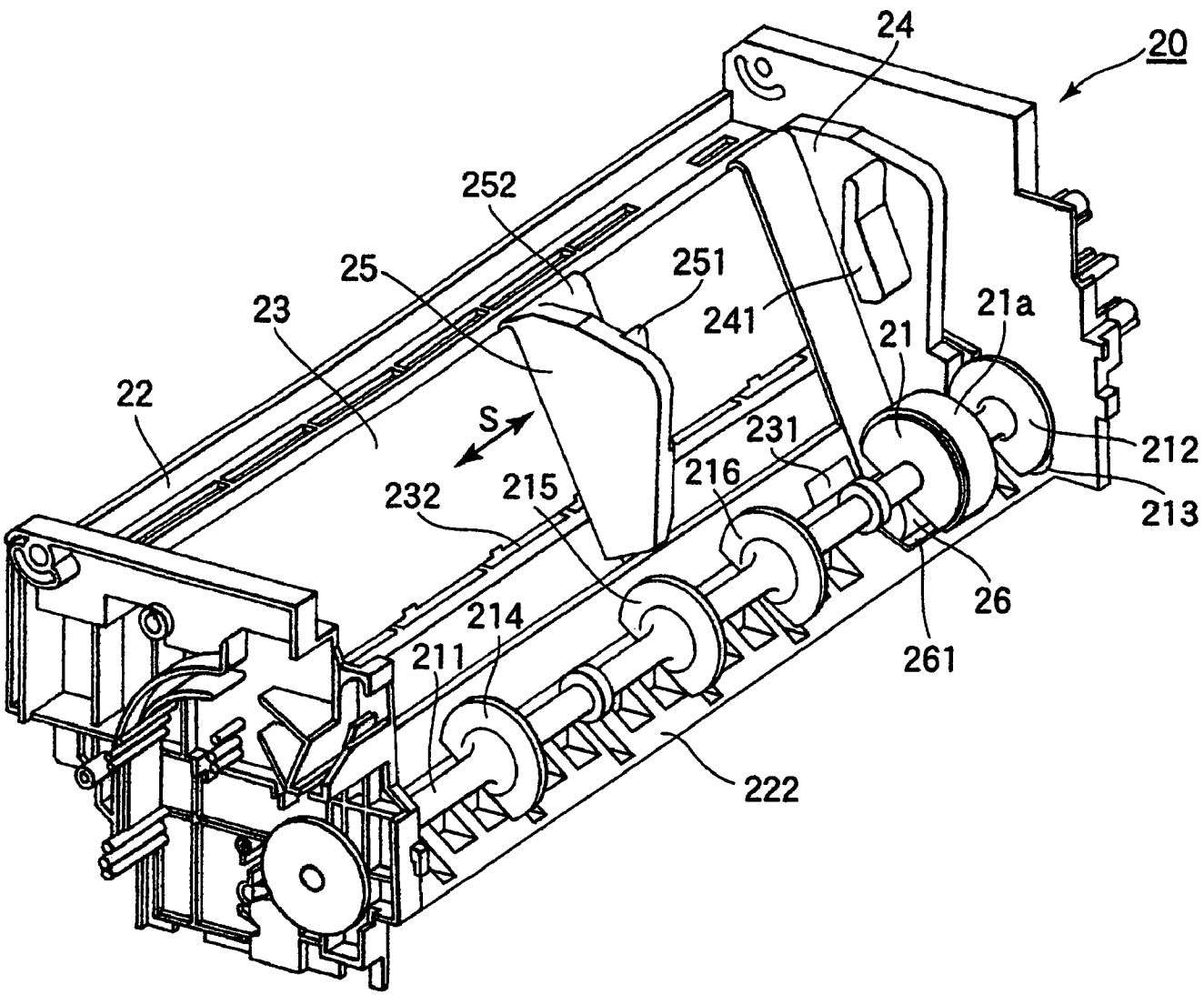
FIG. 5 is a perspective view of essential portions of an automatic paper feeder in accordance with the invention.

FIG. 5 is a perspective view of essential portions of the automatic paper feeder 20. FIG. 6 is a front elevational view of the essential portions of the automatic paper feeder 20. FIG. 7 is a side elevational view of the essential portions of the automatic paper feeder 20.

A supporting surface 221 for supporting the recording paper P stacked on the paper feed tray 22 in a state in which leading ends of the stacked sheets of recording paper P abut is formed on the paper feed tray 22 serving as the "recording material stacking means" on which the recording paper P before execution of recording is stacked The hopper 23 which swings toward the paper feed roller 21 side at a predetermined timing during paper feeding is swingably disposed on the paper feed tray 22 swingably with a shaft 233 as a swinging shaft. The hopper 23 is urged by an unillustrated urging means in a direction of pressing an uppermost sheet P1 of the recording paper against the outer peripheral surface of the paper feed roller 21 from a lowermost sheet side of the recording paper P stacked in the hopper 23. A non-slip member 231 for the recording paper P is disposed in that portion of the hopper 23 where the outer peripheral surface of the paper feed roller 21 abuts. The hopper 23 undergoes cam engagement with a pair of hopper cams 213 respectively formed integrally in vicinities of both ends of the paper feed roller shaft 211, and its swinging position is defined by the hopper cams 213 so that the hopper 23 swings in correspondence with the rotational position of the paper feed roller shaft 211.

The hopper 23 is provided with a reference end guide 24 for defining one end side in the main scanning direction X of the recording paper P stacked on the paper feed tray 22 at a reference end serving as a "recording material reference end" in the main scanning direction X, as well as an edge guide member 25 for guiding the other end side in the main scanning direction X of the recording paper P stacked on the paper feed tray 22. The edge guide member 25 is hooked at its arm portion 252 to an upper end of the hopper 23, and engages thereat an elongated hole 232 elongated in the main scanning direction X and formed in the hopper 23, such that the edge guide member 25 is disposed slidably in directions indicated by reference sign S in correspondence with the size of the recording paper P. A liftup preventing guide 241 for preventing the recording paper P fed from the paper feed tray 22 from lifting up is formed on the reference end guide 24, as shown in the drawings. Similarly, a liftup preventing guide 251 for preventing the recording paper P fed from the paper feed tray 22 from lifting up is formed on the edge guide member 25 as well, as shown in the drawings.

The paper feed roller 21 has its both end portions supported rotatably in the feeding direction of the recording paper P, and is disposed concentrically and integrally with the paper feed roller shaft 211 serving as a "feed roller shaft" which rotates as the rotatively driving force of an automatic paper feed motor 27 (see FIG. 6) is transmitted thereto. The paper feed roller 21 is disposed at a position offset toward the reference end side of the recording paper P in the axial direction of the paper feed roller shaft 211. The paper feed roller 21 has a substantially D-shaped cross-sectional shape having an outer peripheral surface 21*a* serving as a "first outer peripheral surface" whose distance from the axis of the paper feed roller shaft 211 is fixed and a flat outer peripheral surface 21*b* serving as a "second outer peripheral surface" whose distance from the axis of the paper feed roller shaft 211 is set to be shorter than that of the "first outer peripheral surface" (see FIG. 7). A high friction member is disposed uniformly on the outer peripheral surface 21*a* and the outer peripheral surface 21*b* of the paper feed roller 21. In addition, a first paper feed auxiliary roller 214, a second paper feed auxiliary roller 215, and a third paper feed auxiliary roller 216 are formed concentrically and integrally with the paper feed roller shaft 211. The first paper feed auxiliary roller 214, the second paper feed auxiliary roller 215, and the third paper feed auxiliary roller 216 serve as "paper feed auxiliary rollers" for restricting the paper feeding attitude of the recording paper P being fed, by abutting against the vicinity of the other end side of the recording paper P which is fed with its one end side in the main scanning direction X of the recording paper P positioned by the reference end guide 24.

The first paper feed auxiliary roller 214, the second paper feed auxiliary roller 215, and the third paper feed auxiliary roller 216 are thin plate-shaped rotators having substantially the same D-shaped cross-sectional shapes as that of the paper feed roller 21, but a high friction member is not provided on their outer peripheral surfaces. These paper feed auxiliary rollers 214, 215, and 216 are formed with the same phase as that of the paper feed roller 21, and their outside diameters are set to be about 1 to 2 mm smaller than that of the paper feed roller 21. When the recording paper P is fed by the rotation of the paper feed roller 21 disposed in the vicinity of the one end side in the main scanning direction X, the respective outer peripheral surfaces of the first paper feed auxiliary roller 214, the second paper feed auxiliary roller 215, and the third paper feed auxiliary roller 216 abut against the recording surface (upper surface) on the other end side in the main scanning direction X. As a result, the leading end of the recording paper P is guided toward the nips between the transport drive roller 41 and the transport driven rollers 42 while the lifting up of the recording paper P at the other end side in the main scanning direction X is being prevented, and the feeding attitude of the recording paper P fed is being restricted. The recording paper P is fed in a state of being in uniform surface contact with a paper feed guide surface 222 formed on the paper feed tray 22 and a paper feed guide surface 444 formed on the paper feed guide member 44, thereby preventing a skew and the like of the recording paper P during paper feeding.

The first paper feed auxiliary roller 214 is formed at a position corresponding to a vicinity of the other end side in the main scanning direction X of the recording paper P in a case where A3-size recording paper P is stacked on the paper feed tray 22. The second paper feed auxiliary roller 215 is formed at a position corresponding to a vicinity of the other end side in the main scanning direction X of the recording paper P in a case where A4-size recording paper P is stacked on the paper feed tray 22. The third paper feed auxiliary roller 216 is formed at a position corresponding to recording paper P of a size smaller than the A4-size recording paper P. Further, a fourth paper feed auxiliary roller 212 is formed on the paper feed roller shaft 211 at a position closer to an end portion of the reference end side than the paper feed roller 21, thereby preventing the lifting up of the recording paper P in the vicinity of the one end side in the main scanning direction X. The fourth paper feed auxiliary roller 212 demonstrates a large effect particularly in the case of small recording paper P such as a name card size.

A retard roller 26 and a retard roller holder 261 are disposed at a position corresponding to the outer peripheral surface 21*a* and the outer peripheral surface 21*b* of the paper feed roller 21. The retard roller 26 and the retard roller holder 261 serve as "recording material separating means" for separating from the recording paper P1 being fed the other recording paper P which tends to enter the feeding path by being dragged by the recording paper P1 being fed when the recording paper P1 abutting against the outer peripheral surface 21*a* of the paper feed roller 21 is fed by the rotation of the paper feed roller 21 in the feeding direction. The retard roller 26 is a rotator provided with a high friction member such as a rubber material on its outer peripheral surface, has a substantially fixed resistance against driven rotation in the paper feeding direction, and is disposed by being rotatably supported by the retard roller holder 261. The retard roller holder 261 is pivotally supported by the paper bed tray 22 swingably with a shaft 262 as a swinging shaft, and one end side of a spring 263 whose other end side is retained by a portion of the paper feed tray 22 is connected thereto. Hence, the retard roller holder 261 is disposed by being urged such that the outer peripheral surface of the retard roller 26 presses the outer peripheral surface 21*a* of the paper feed roller 21 with a predetermined pressing force.

As for the retard roller holder 261, its swung position at which the outer peripheral surface of the retard roller 26 assumes a state of slightly projecting from the paper feed guide surface 222 is set as its position of a displacement limit in the pressing direction. For this reason, in a state of opposing the outer peripheral surface 21*a* of the paper feed roller 21 (during the paper feeding operation), the outer peripheral surface of the retard roller 26 abuts against the outer peripheral surface 21*a* with an appropriate pressing force, whereas in a state of opposing the outer peripheral surface 21*b* of the paper feed roller 21 (after the leading end of the recording paper P fed has been nipped by the transport drive roller 41 and the transport driven rollers 42), the outer peripheral surface of the retard roller 26 is spaced away from the outer peripheral surface 21*b*. As a result, back tension by the retard roller 26 is prevented from being applied to the recording paper P being nipped by the transport drive roller 41 and the transport driven rollers 42 and being transported in the sub scanning direction Y.

In the state in which the outer peripheral surface 21*a* of the paper feed roller 21 abuts against the outer peripheral surface of the retard roller 26 with an appropriate pressing force, and a plurality of sheets of recording paper P in an overlapped state are being nipped between the outer peripheral surface 21*a* of the paper feed roller 21 and the retard roller 26, the driven rotation resistance of the retard roller 26 is set to be smaller than the frictional resistance between the outer peripheral surface 21*a* of the paper feed roller 21 and the outer peripheral surface of the retard roller 26 and to be greater than the frictional resistance between the sheets of recording paper P in the overlapped state. As a result, only the recording paper P1 which abuts against the outer peripheral surface 21*a* of the paper feed roller 21 and is to be fed is fed by the rotation of the paper feed roller 21. The other overlapping sheets of recording paper P below the recording paper P1 to be fed are separated from the recording paper P1 to be fed by the driven rotation resistance of the retard roller 26, and their entry into the farther side of the nip between the outer peripheral surface 21*a* of the paper feed roller 21 and the outer peripheral surface of the retard roller 26 is prevented. Therefore, it is possible to prevent a plurality of sheets of recording paper P from being fed in the overlapping state.

As for the other sheets of recording paper P separated from the recording paper P1 to be fed by the driven rotation resistance of the retard roller 26, there are cases where their leading ends remain in the vicinity of the retard roller 26. For this reason, the automatic paper feeder 20 is provided with a paper return lever 28 (FIG. 7) for pushing back the leading ends of the separated sheets of recording paper P to a predetermined position (the state in which the leading ends of the stacked sheets of recording paper P abut against the supporting surface 221). The paper return lever 28 is pivotally supported swingably with a shaft 281 serving as a swinging shaft, and is disposed such that its paper returning surface 282 swings so as to advance to or retract from the paper feed guide surface 222 in correspondence with the rotational position of the paper feed roller 21. The recording paper P whose leading end has advanced to the vicinity of the retard roller 26 is pushed back to its predetermined position in the paper feed tray 22 as its leading end is pushed back toward the paper feed tray 22 side by the paper returning surface 282 of the paper return lever 28 which advances to the paper feed guide surface 222.

Next, referring to FIGS. 8 to 11, a description will be given of an outline of the operation of the automatic paper feeder 20.

Figure 8:
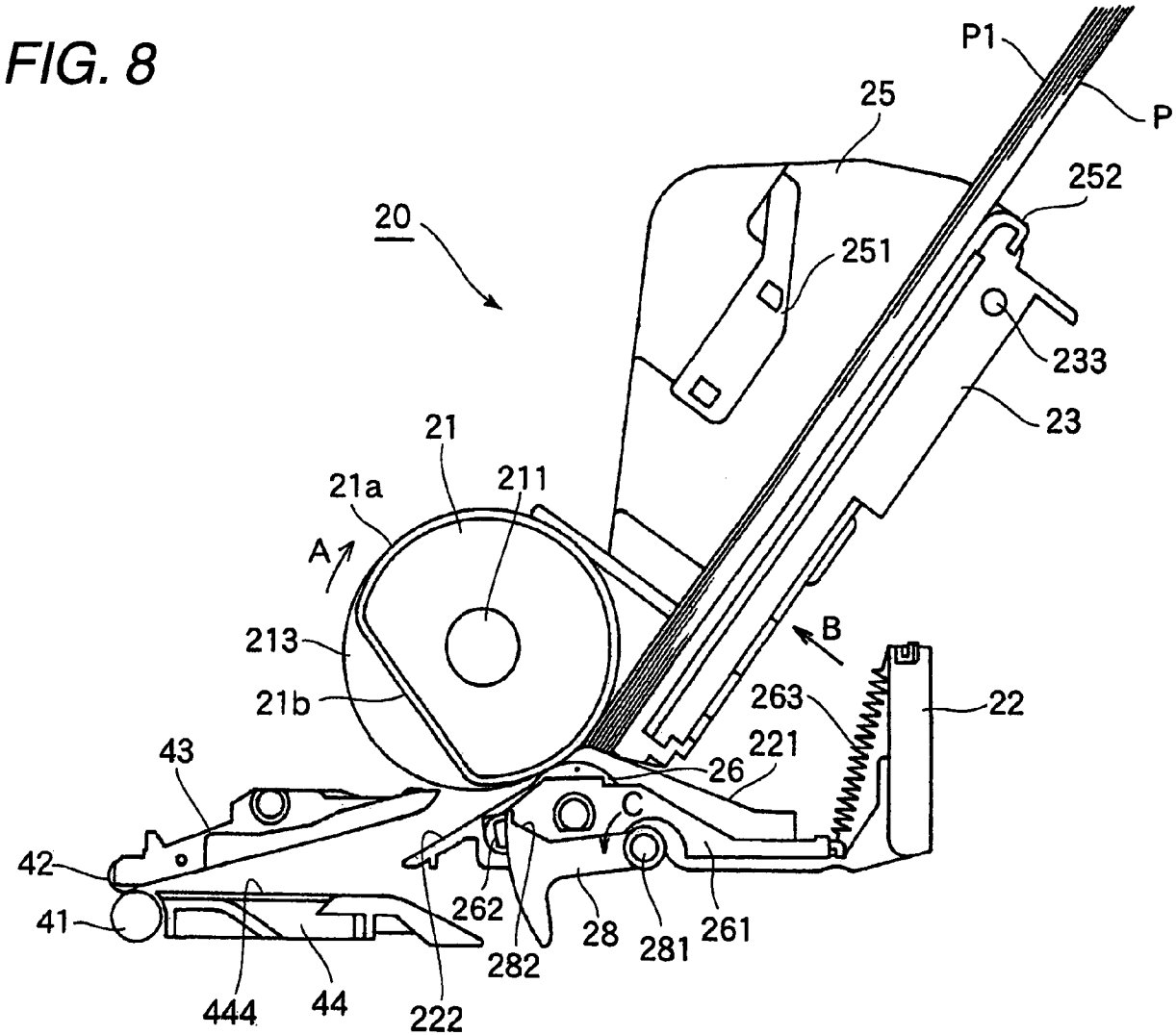
FIG. 8 is a side elevational view of the essential portions of the automatic paper feeder, illustrating a state immediately after the start of the paper feeding operation
Figure 9:
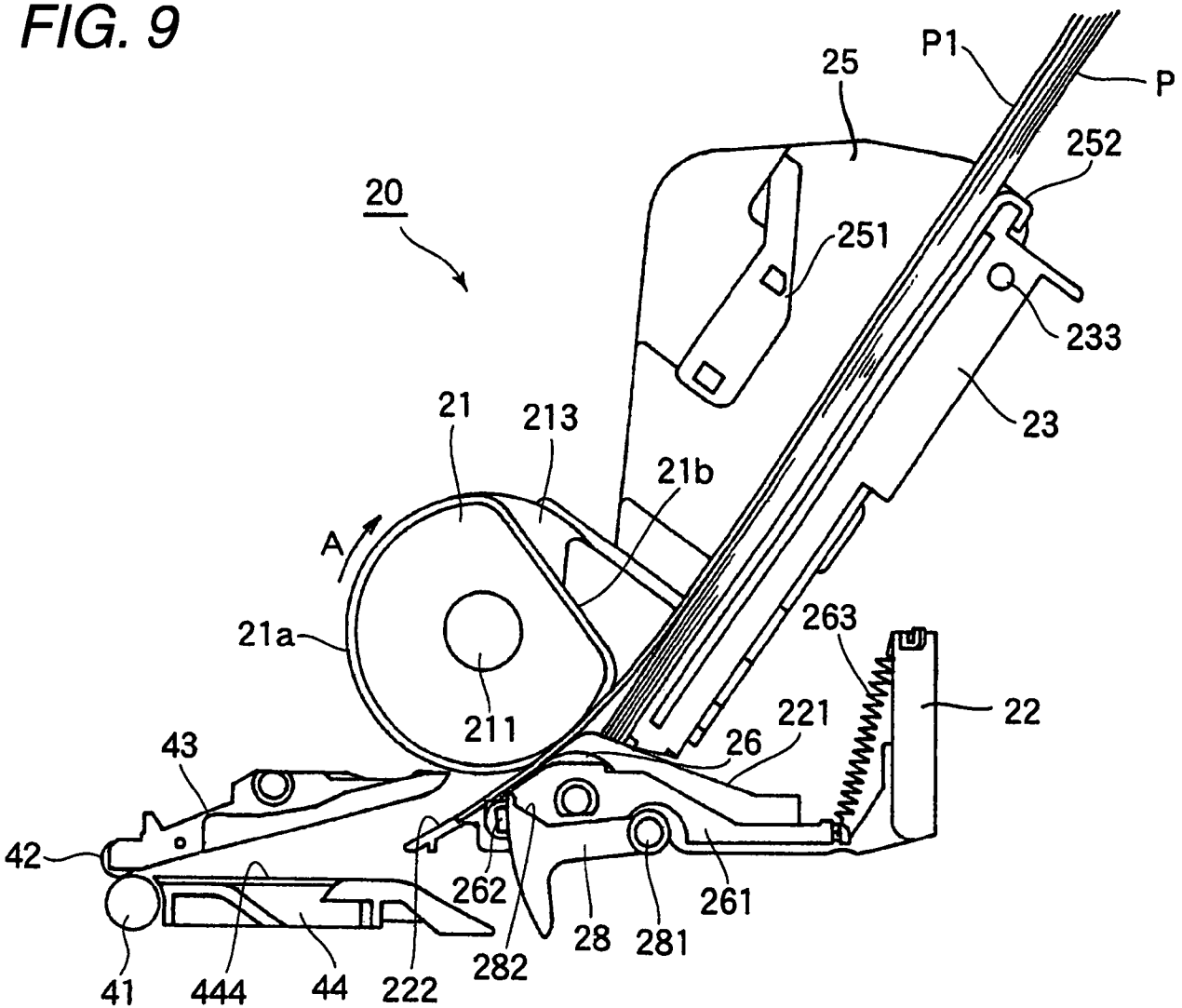
FIG. 9 is a side elevational view of the essential portions of the automatic paper feeder, illustrating a state of paper feeding in operation.
Figure 10:
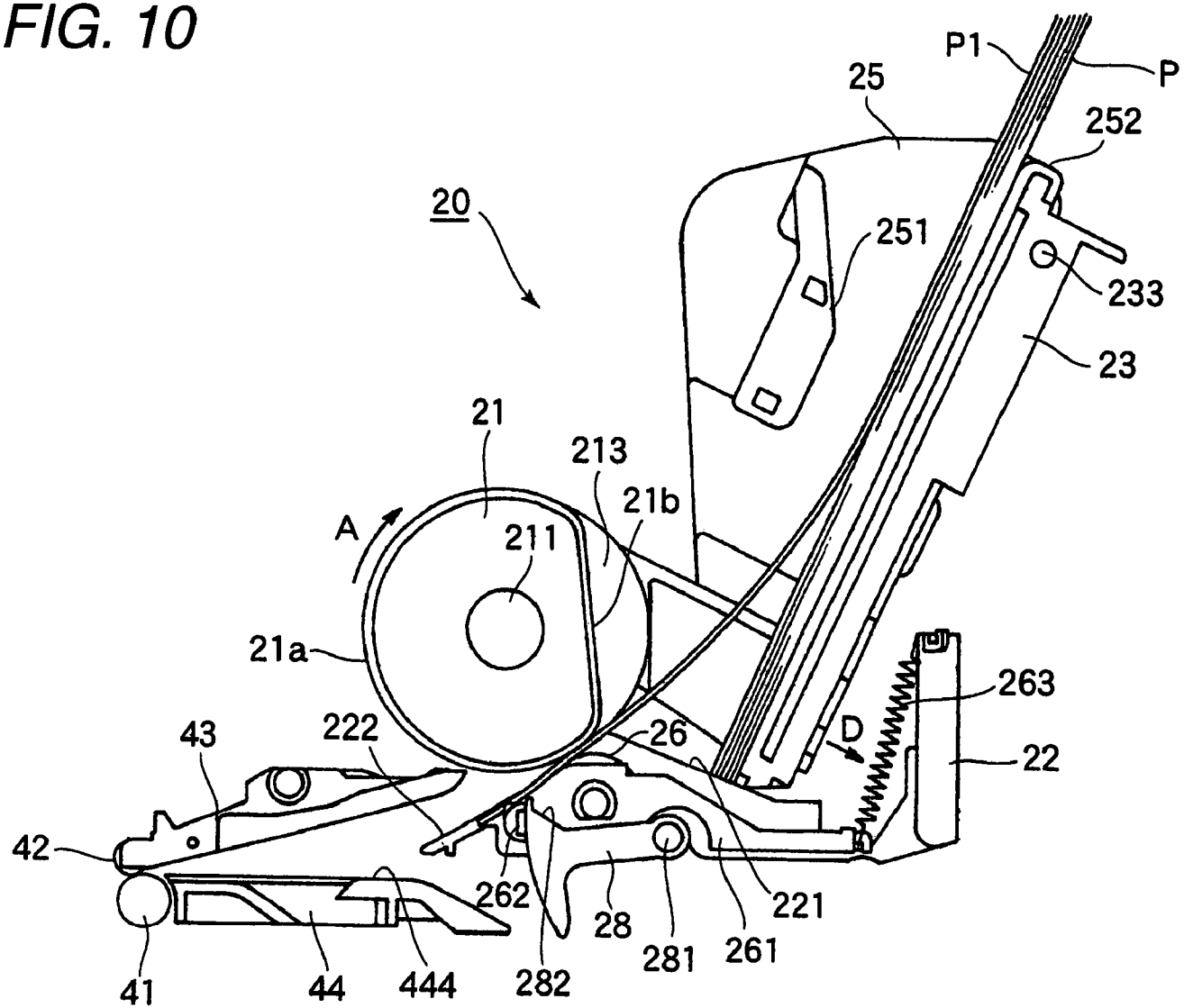
FIG. 10 is a side elevational view of the essential portions of the automatic paper feeder, illustrating a state immediately before completion of the paper feeding operation.
Figure 11:
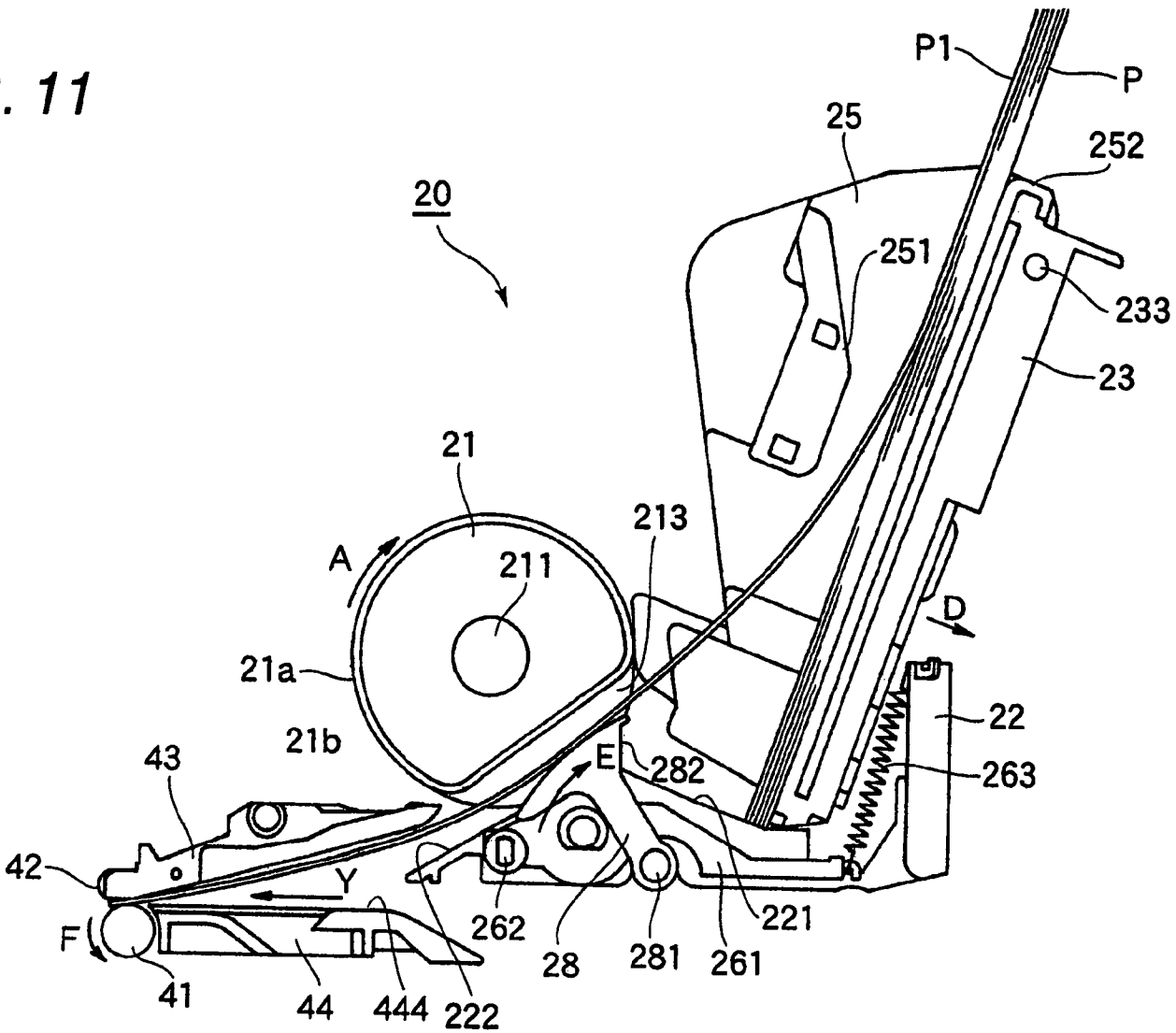
FIG. 11 is a side elevational view of the essential portions of the automatic paper feeder, illustrating a state after completion of the paper feeding operation.

FIGS. 8 to 11 are side elevational views of essential portions of the automatic paper feeder 20. FIG. 8 shows a state immediately after the start of the paper feeding operation in the state shown in FIG. 7 (state of waiting for paper feeding). FIG. 9 shows a state of paper feeding in operation. FIG. 10 shows a state immediately before completion of the paper feeding operation. FIG. 11 shows a state after completion of the paper feeding operation.

When the paper feed roller 21 starts to rotate in the rotating direction indicated by reference character A, the hopper 23 swings in the swinging direction indicated by reference character B. As a result, the uppermost recording paper P1 among the sheets of recording paper P stacked in the paper feed tray 22 is pressed and abutted against the outer peripheral surface 21*a* of the paper feed roller 21. Meanwhile, the paper return lever 28 swings in the swinging direction indicated by reference character C, and its paper returning surface 282, which advanced toward the paper feeding path side relative to the paper feed guide surface 222 in such a manner as to block the paper feeding path, retreats from the paper feeding path (FIG. 8).

When the paper feed roller 21 further rotates in the rotating direction indicated by the reference character A, the recording paper P1 which is abutting against the outer peripheral surface 21*a* of the paper feed roller 21 and is to be fed is fed in the paper feeding direction. As described before, the other sheets of recording paper P in the overlapping state below the recording paper P1 to be fed are separated from the recording paper P1 to be fed by the driven rotation resistance of the retard roller 26, and their entry into the farther side of the nip between the outer peripheral surface 21*a* of the paper feed roller 21 and the outer peripheral surface of the retard roller 26 is prevented (FIG. 9).

When the paper feed roller 21 further rotates in the rotating direction indicated by the reference character A, the recording paper P1 is fed while being guided toward the paper feed guide surface 444 of the paper feed guide member 44 in a state in which the leading end of the recording paper P1 to be fed is brought into surface contact with the paper feed guide surface 222. In addition, in the meanwhile, at a point of time when the paper feed roller 21 has rotated to a predetermined rotated position, the hopper 23 swings in the swinging direction indicated by reference character D. At this time, most of the sheets of recording paper P return to the predetermined position in the paper feed tray 22, but there are cases where leading ends of some of the sheets of recording paper P separated from the recording paper P1 to be fed by the driven rotation resistance of the retard roller 26 still remain in the vicinity of the retard roller 26 (FIG. 10).

When the paper feed roller 21 further rotates in the rotating direction indicated by the reference character A, the paper return lever 28 swings in the swinging direction indicated by reference character E, and its paper returning surface 282 advances to the paper fed guide surface 222. The sheets of recording paper P whose leading ends still remain in the vicinity of the retard roller 26 are pushed back toward the predetermined position in the paper feed tray 22 by the paper returning surface 282 of the paper return lever 28. Meanwhile, the recording paper P1 to be fed reaches the nip between the transport drive roller 41 and the transport driven rollers 42 while its leading end is being guided by being brought into surface contact with the paper feed guide surface 444 of the paper feed guide member 44, and the recording paper P1 is set in a nipped state by being brought into contact with and is drawn by the outer peripheral surface of the transport drive roller 41 which rotates in the rotating direction indicated by reference character F. The paper feed roller rotates until its outer peripheral surface 21*b* reaches a rotated position opposing the outer peripheral surface of the retard roller 26, and the nipped state of the recording paper P1 to be fed by the paper feed roller 21 and the retard roller 26 is released, thereby completing the series of the paper feeding operation. Control of the recording execution with respect to the recording paper P1 fed is started, and the recording paper P1 is transported in the sub scanning direction Y by the rotation of the transport drive roller 41 in the rotating direction indicated by the reference character F (FIG. 11).

Thus, the plurality of sheets of recording paper P stacked on the paper feed tray 22 are automatically fed one sheet at a time toward nips between the outer peripheral surface of the transport drive roller 41 and the outer peripheral surfaces of the transport driven rollers 42.

Next, referring to FIGS. 12 to 14, a farther description will be given of the construction of the recording material guiding device in accordance with the invention.

Figure 12A:
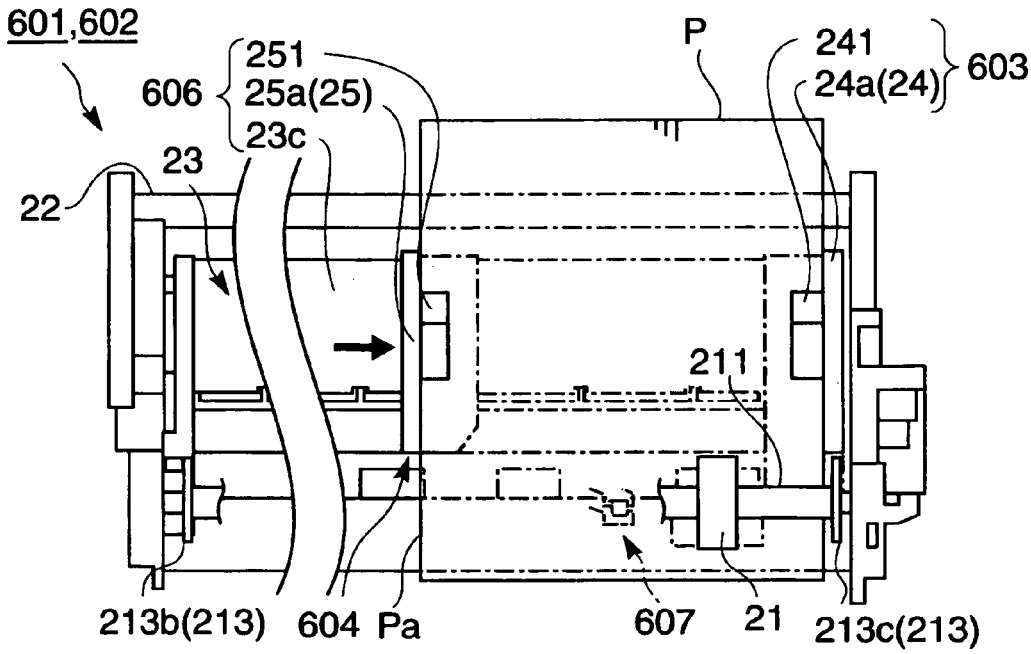
FIGS. 12A and 12B are plan views of a recording material guiding device in accordance with the invention.
Figure 12B:
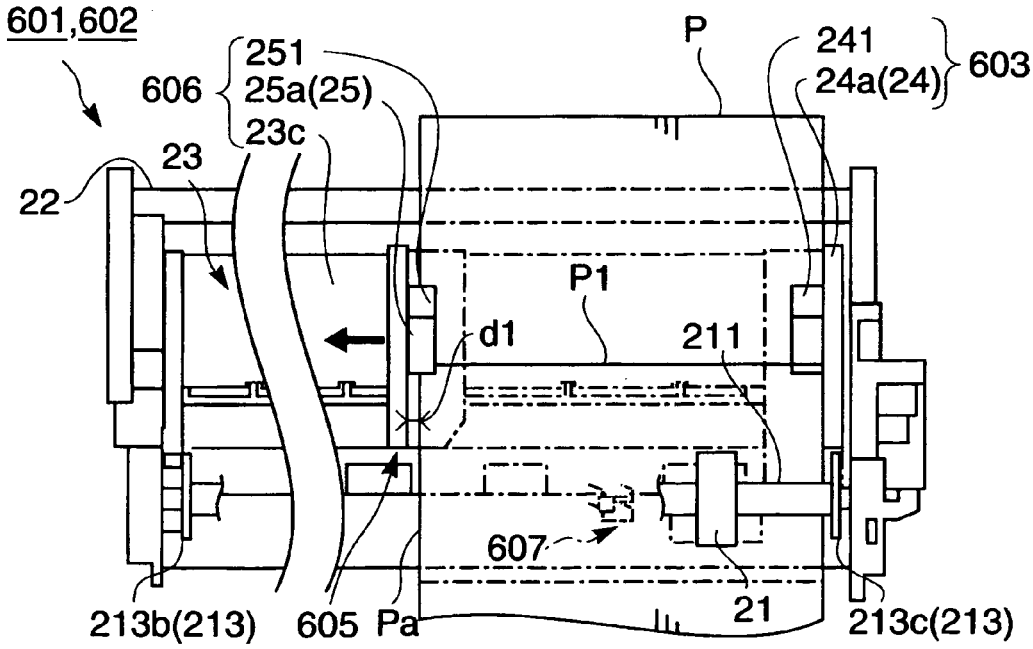

FIGS. 12A and 12B are plan views of the recording material guiding device in accordance with the invention. FIG. 12A shows a state in which a second guide member is located at a first position, and FIG. 12B shows a state in which the second guide member is located at a second position.

Figure 13A:
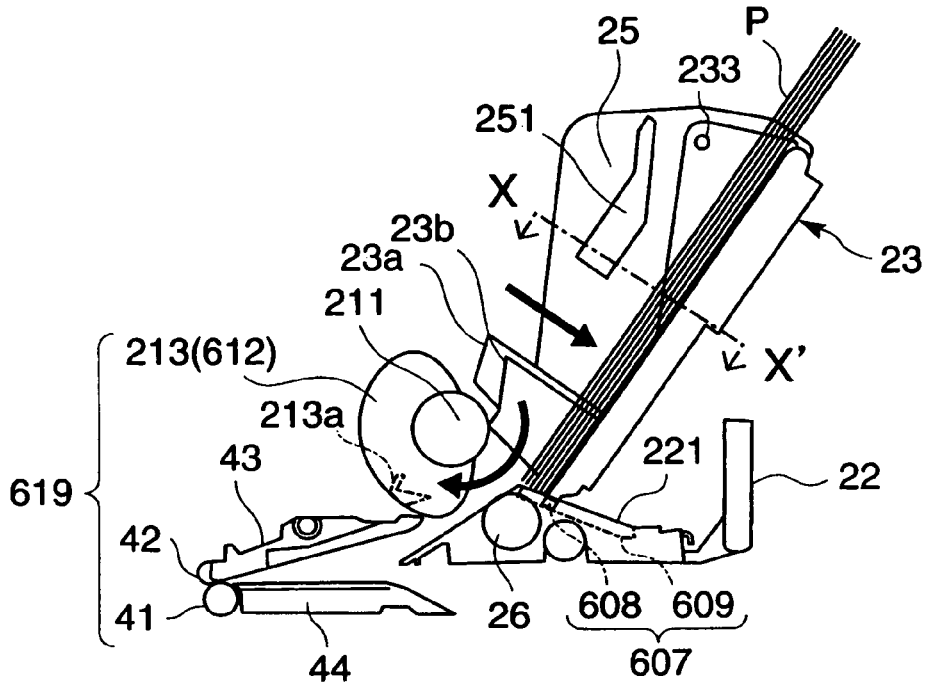
FIGS. 13A and 13B are side elevational views of the recording material guiding device shown in FIGS. 12A and 12B.
Figure 13B:
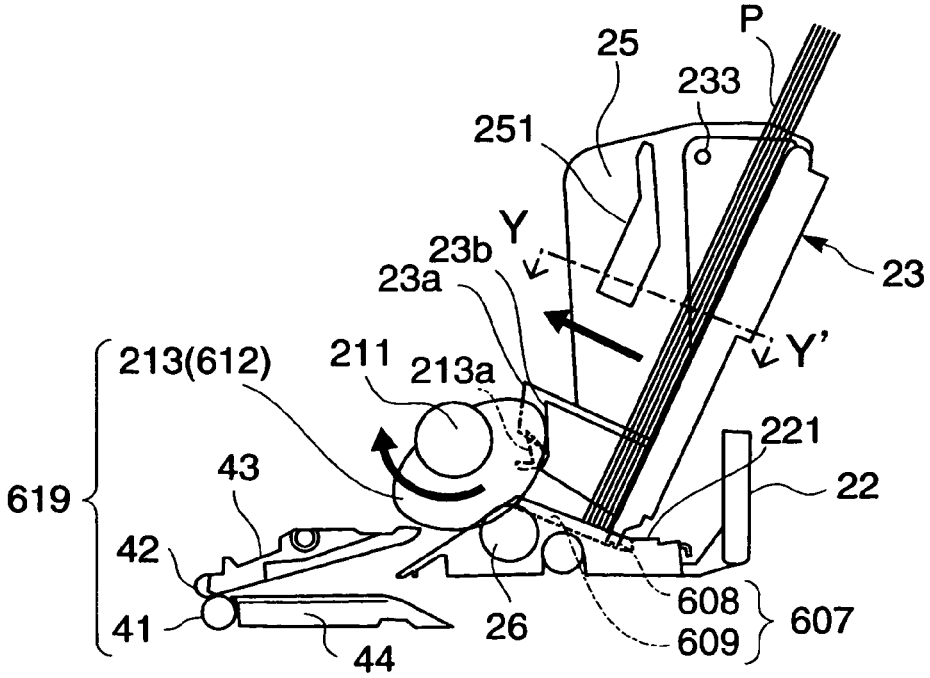

FIGS. 13A and 13B are side elevational views of the recording material guiding device shown in FIGS. 12A and 12B, and respectively correspond to FIGS. 12A and 12B.

Figure 14A:
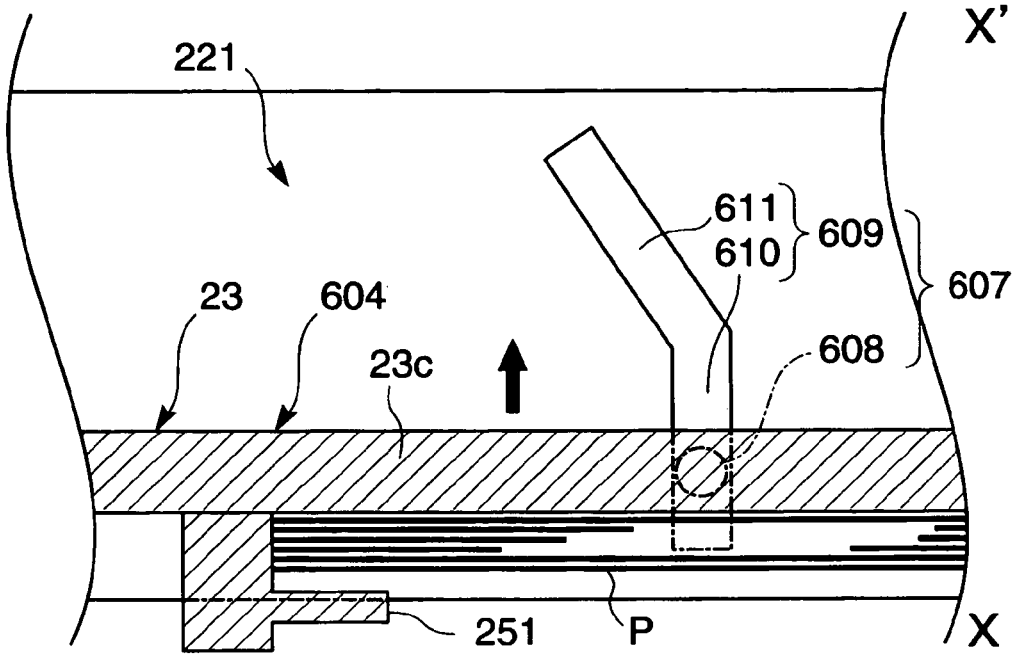
FIGS. 14A and 14B are plan views of essential portions of a moving direction converting mechanism of the recording material guiding device shown in FIGS. 18A and 18B.
Figure 14B:
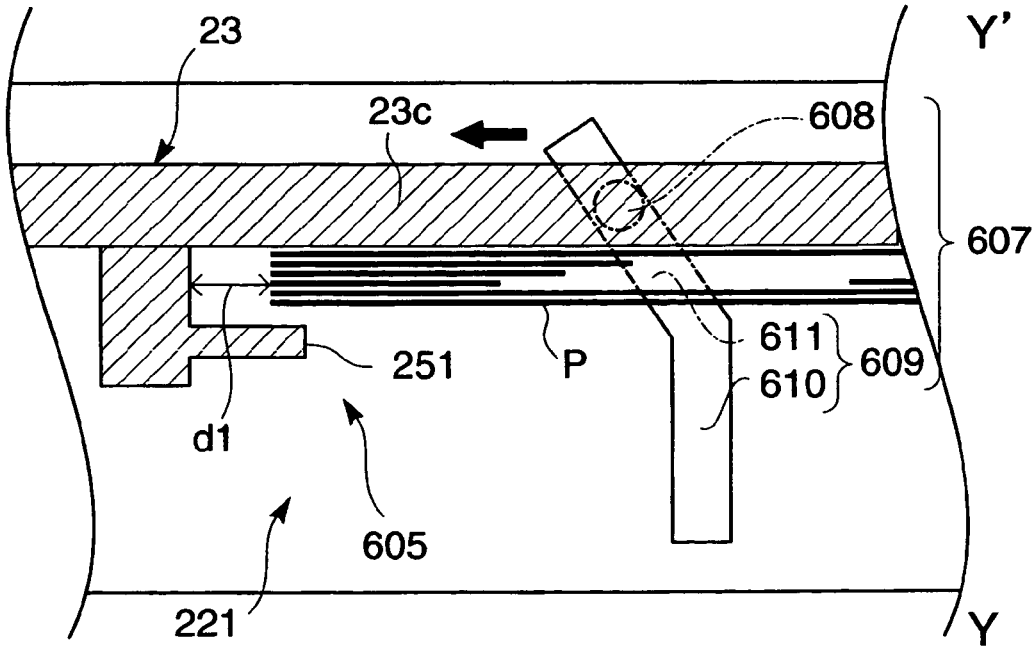

FIGS. 14A and 14B are plan views of essential portions of a moving direction converting mechanism of the recording material guiding device shown in FIGS. 13A and 13B. FIG. 14A is a cross-sectional view taken along line X-X' in FIG. 13A, and FIG. 14B is a cross-sectional view taken along line Y-Y' in FIG. 13B.

First, a description will be given with reference to FIG. 12A.

A recording material guiding device 601 in accordance with the invention has the paper feed tray serving as the "feed tray" in which the recording paper P serving as the "recording material" is stacked; a first side end guiding member 24*a* and a second side end guide member 25*a* for restricting the movement of the recording paper P in the main scanning direction; and the hopper 23 having the first side end guiding member 24*a* and the second side end guide member 25*a* and capable of causing the stacked recording paper P to be brought into contact with and move away from the paper feed roller 21 serving as a "feed roller."

The hopper 23 in accordance with the invention has a frictional contact preventing means 602 for preventing frictional contact at least between one side end (opposite side to Pa) of the recording paper P and the first side end guiding member 24*a* or between the other side end Pa and the second side end guide member 25*a* during recording.

The frictional contact preventing means 602 is comprised of a first guide member 603 which has the first side end guiding member 24*a* and whose sliding movement in the main scanning direction is restricted, as well as a second guide member 606 which has the second side end guide member 25*a*, is engaged with the first guide member 603, and is slidable in the main scanning direction with respect to the first side end guiding member 24*a* up to a first position 604 (see FIG. 12A) and a second position 605 (see FIG. 12B). The arrangement provided is such that the first position 604 is a position where the second side end guide member 25*a* and the one side end Pa of the recording paper P abut, and the second position 605 is a position for forming a gap d1 (see FIG. 12B) between the second side end guide member 25*a* and the one side end Pa of the recording paper P.

The second guide member 606 in accordance with this embodiment is comprised of a hopper swinging surface 23*c*, the edge guide member 25 including the second side end guide member 25*a*, and the liftup preventing guide 251, and the hopper singing surface 23*c* is engaged in an opening (not shown) provided in a side surface of the reference end guide 24 serving as the first guide member 603. Accordingly, the second guide member 606 can be slid in the main scanning direction with respect to the reference end guide 24 (first guide member 603). Namely, during recording, the gap d1 can be formed between the second side end guide member 25*a* and the side end Pa of the recording paper P by sliding the second side end guide member 25*a* from the first position 604 to the second position 605, so that fictional contact can be prevented at the side end Pa of the recording paper P on the second side end guide member side.

Consequently, back tension can be set to nil at least at the one side end Pa of the recording paper P. Accordingly, it is possible to improve the recording image quality since back tension can be reduced remarkably even in the case of the large A3 or the like having a large paper size in which the back tension is likely to occur.

In this embodiment, the swinging position of the hopper 23 is defined as the hopper 23 abuts against a first cam 213C and a second cam 213*b* so as to swing in correspondence with the rotational position of the paper feed roller shaft 211.

Here, the frictional contact preventing means 602 has a moving direction converting mechanism 607 for converting the force for causing the hopper 23 to be brought into contact with and move away from the paper feed roller 21 into the force for causing the second guide member 606 to slide in the main scanning direction. Accordingly, by causing the hopper 23 to move toward and away from the paper feed roller, the second guide member 606 can be slid to the first position 604 or the second position 605. Next, a detailed description will be given of the moving direction converting mechanism 607 in accordance with this embodiment.

FIGS. 13A and 13B are side elevational views of FIGS. 12A and 12B and respectively correspond thereto. As shown in FIGS. 13A and 13B, the hopper 23 is adapted to swing with the shaft 233 as a fulcrum as the cam 213 (a cam projection 213*a* which will be described later) abuts against a first abutment portion 23*b* (a second abutment portion 23*a* which will be described later) of the hopper 23.

Here, the moving direction converting mechanism 607 in accordance with the invention has a guide projection 608 provided on the second guide member 606 and a guide groove 609 provided in the supporting surface 221 of the paper feed tray 22 for engagement with the guide projection 608. As shown in FIGS. 13A and 13B, the guide projection 608 is adapted to move along the guide groove 609. Next, a detailed description will be given of the guide groove 609 in accordance with this embodiment.

It should be noted that a description will be given later of an unskewing means denoted by reference numeral 619.

FIGS. 14A and 14B are plan views of essential portions of the moving direction converting mechanism 607 of the recording material guiding device 601 shown in FIGS. 13A and l3B. FIG. 14A is a cross-sectional view taken along line X-X' in FIG. 13A, and 14B is a cross-sectional view taken along line Y-Y' in FIG. 13B.

The guide groove 609 in accordance with this embodiment includes a rectilinear portion 610 provided on the paper feed roller side and extending in the same direction as the direction in which the hopper 23 is brought into contact with and moves away from the paper feed roller 21, as well as an inclined portion 611 provided on the side away from the paper feed roller 21 and inclined with respect to the rectilinear portion 610.

As shown in FIGS. 14A and 14B, when the second guide member 606 is swung so as to move away from the paper feed roller 21 from the paper feed roller side, the guide projection 608 provided on the second guide member 606 passes along the rectilinear portion 610 of the guide groove 609, as shown in FIG. 14A, and then passes along the inclined potion 611, as shown in FIG. 14B. Accordingly, the moving direction of the guide projection 608 can be changed by the inclined portion 611. Namely, the guide projection 608 can be moved in the main scanning direction as well by the inclined portion 611. As a result the second guide member 606 having the guide projection 608 can be moved in the main scanning direction as well, so that the gap d1 can be provided between the side end Pa of the recording paper P and the second side end guide member 25*a*. Namely, the second guide member 606 can be slid to the first position 604 or the second position 605.

In addition, it is possible to make use of the power source for swinging the hopper 23 toward the paper feed roller 21, and a new power source is not required.

Thus, the moving direction converting mechanism 607 can be constructed simply by merely providing the guide projection 608 on the second guide member 606 and the guide groove 609 in the supporting surface 221 of the paper feed tray 22 for engagement with the guide projection 608.

Further, since the guide groove 609 has the rectilinear portion 610 and the inclined portion 611, it is possible to control the sliding motion of the second guide member 606 in the main scanning direction on the basis of one cycle of the swinging motion of the hopper 23 toward the paper feed roller 21.

Furthermore, since the guide groove 609 has the rectilinear portion 610 on the paper feed roller side and the inclined portion 611 on the side away from the paper feed roller 21, there is no possibility of hampering the pressing of the recording paper P against the paper feed roller 21, which is the essential operational effect of the hopper 23.

In this embodiment, the liftup preventing guide 251 disposed on the second side end guide member 25*a* for preventing the lifting up of the stacked recording paper P extends at least the length from the first position 604 to the second position 605 in the main scanning direction. Accordingly, the liftup preventing guide 251 is capable of abutting against the surface of the stacked recording paper P even if the second guide member 606 is in the state of being located at the second position 605. As a result, it is possible to prevent the lifting up of the recording paper P even if the second guide member 606 is in the state of being located at the second position 605.

When the second guide member 606 slides from the first position 604 to the second position 605, control is provided by the cams. Accordingly, in the second guide member 606 on the sliding side, the first abutment portion 23*b* which abuts the cam also slides. Namely, there is a possibility of the cam engagement between the second cam 213*b* and the first abutment portion 23*b* becoming disengaged due to the sliding of the second guide member 606.

Figure 15A:
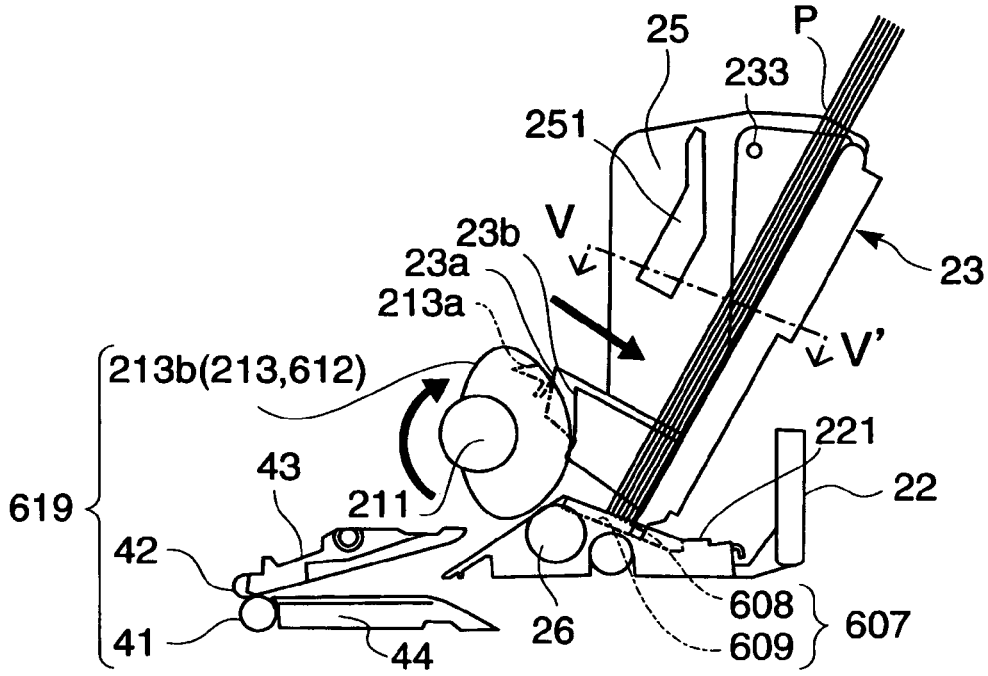
FIGS. 15A and 15B are side elevational views illustrating a guide member control portion in accordance with the invention.
Figure 15B:
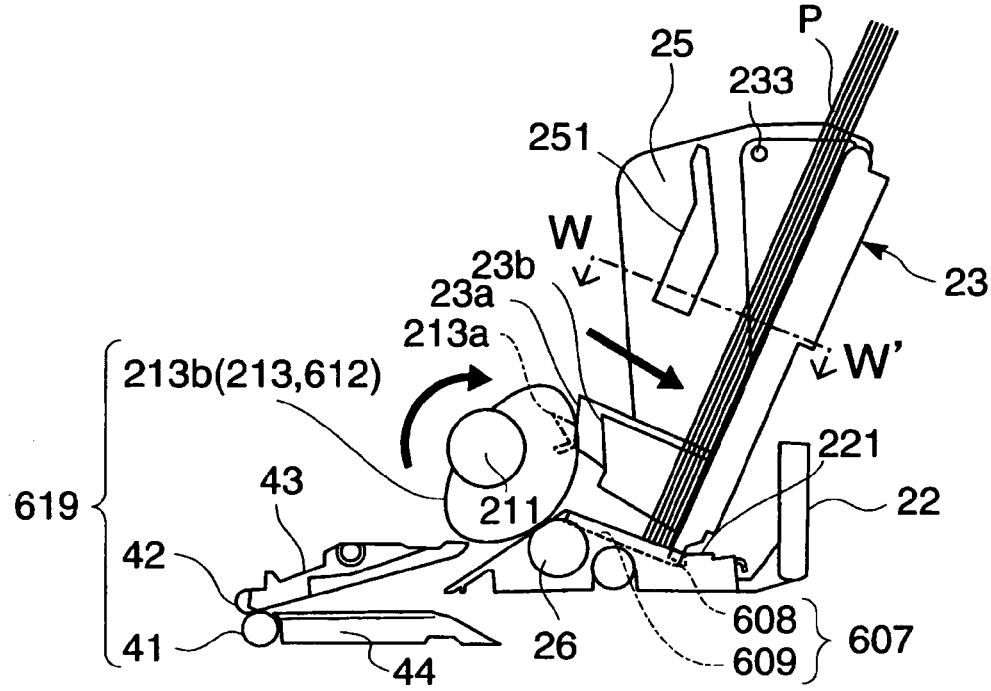

Accordingly, shown in FIGS. 15A and 15B are side elevational views illustrating a guide member control portion 612 in accordance with the invention. FIG. 15A shows a state in which the guide projection 608 is about to move from the rectilinear portion 610 to the inclined portion 611, i.e., the second guide member 606 is located at the first position 604.

FIG. 15B shows a state in which the guide projection 608 has advanced along the inclined portion 611, i.e., the second guide member 606 is located at the second position 605.

The second cam 213*b* in accordance with this embodiment is provided with the cam projection 213*a* which extends at least a length (d1) from the first position 604 to the second position 605 in the main scanning direction, and the cam projection 213*a* is arranged to abut against the second abutment portion 23*a* of the hopper 23 on the other side.

Figure 16A:
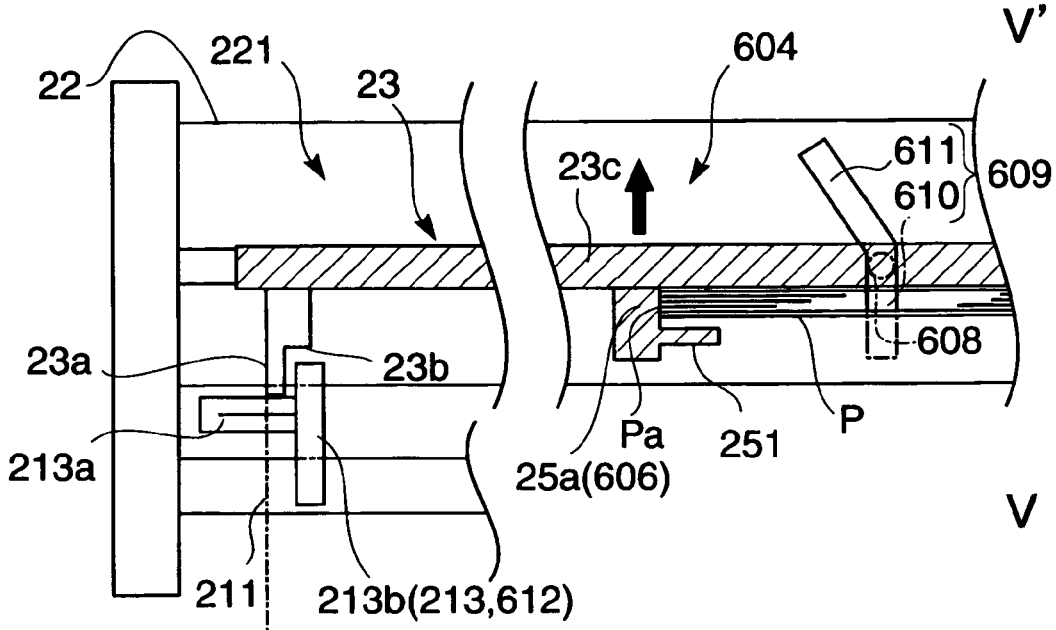
FIGS. 16A and 16B cross-sectional views of essential portions of the guide member control portion shown in FIGS. 15A and 15B.
Figure 16B:
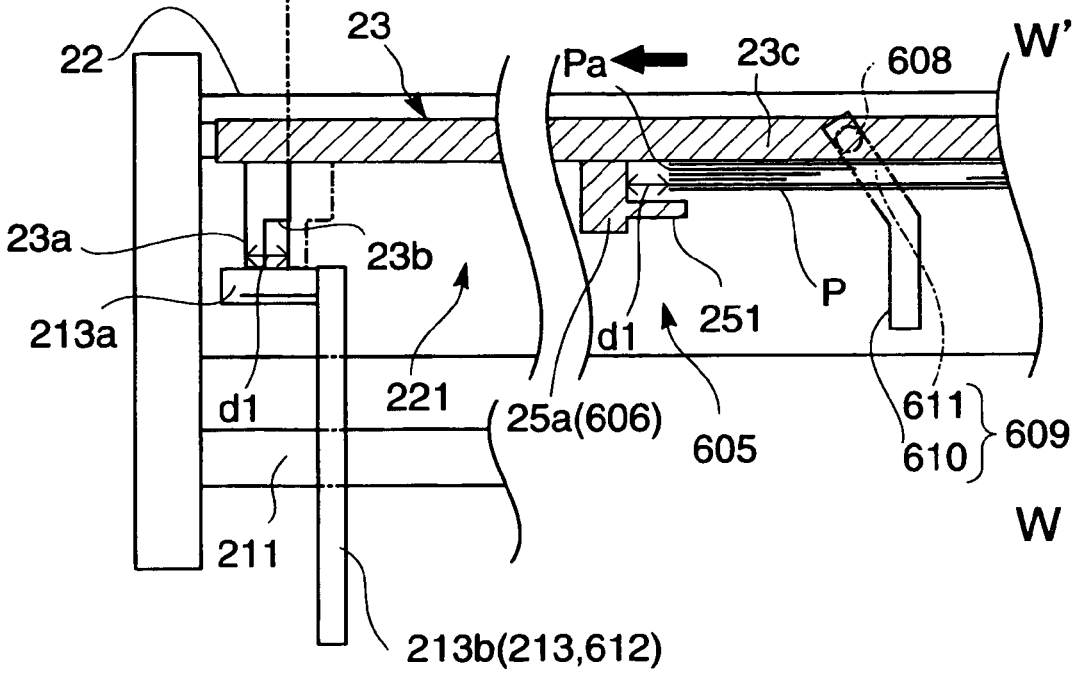

FIGS. 16A and 16B are plan views of essential portions of the guide member control portion 612 and the moving direction converting mechanism 607 of the recording material guiding device 601 shown in FIGS. 16A and 15B. FIG. 16A is a cross-sectional view taken along line V-V' in FIG. 15A, and 16D is a cross-sectional view taken along line W-W' in FIG. 15B.

As shown in FIGS. 16A and 16B, the second cam 213*b* in accordance with this embodiment is provided with the cam projection 213*a* which extends at least the length (d1), from the first position 604 to the second position 605 in the main scanning direction, and the cam projection 213*a* is arranged to abut against the second abutment portion 23*a* of the hopper 23 on the other side. Therefore, control can be provided even in the case where the second guide member 606 has slid the distance d1 from the first position 604 and moved to the second position 605.

Since the above-described arrangement is provided, depending on the shape of the hopper cam 218, i.e., the guide member control portion 612, or depending on the setting of the rectilinear portion 610 and the inclined portion 611 of the moving direction converting mechanism 607, control can be provided such that the second guide member 606 slides from the second position 605 to the first position 604 until the ensuing recording paper P to be recorded is fed. Accordingly, in the case where the ensuing recording paper P (stacked recording paper) has offset in the main scanning direction due to the gap d1 during recording, the second side end guide member 25*a* is capable of pushing back the side end Pa of the offset recording paper P to rearrange the side end Pa of the recording paper P until the next feeding.

Further, the recording material guiding device 601 in accordance with this embodiment has a recording material detector provided on the transport driven roller holder 43 (FIGS. 13A and 13B) on the downstream side of the hopper 28 to detect a rear end Pb of the recording paper P.

Figure 17A:
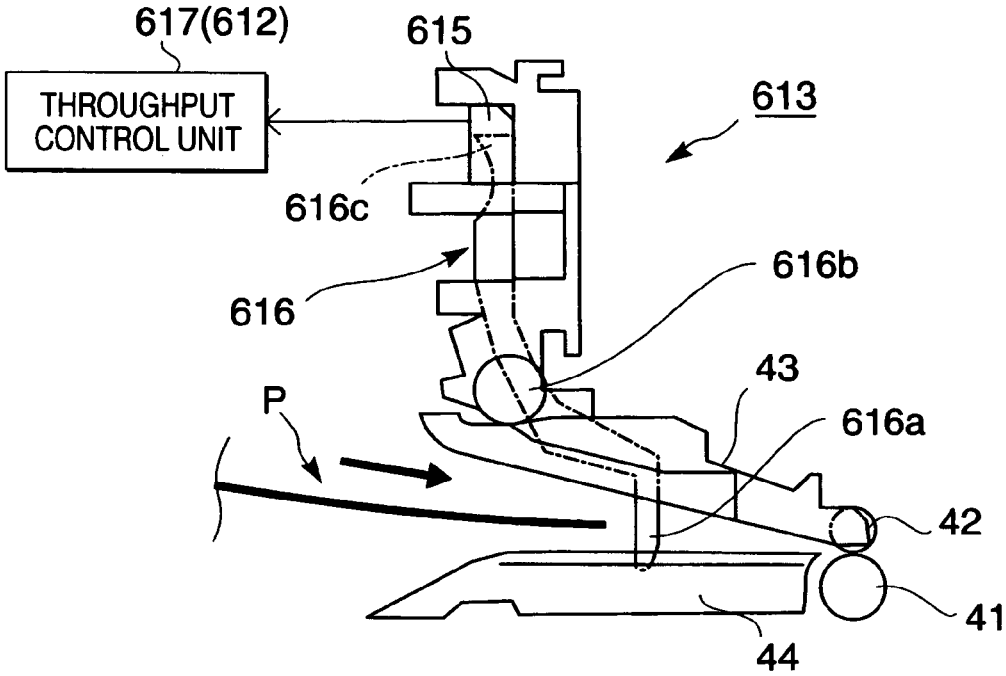
FIGS. 17A and 17B are side elevational views of a recording material detector in accordance with the invention.
Figure 17B:
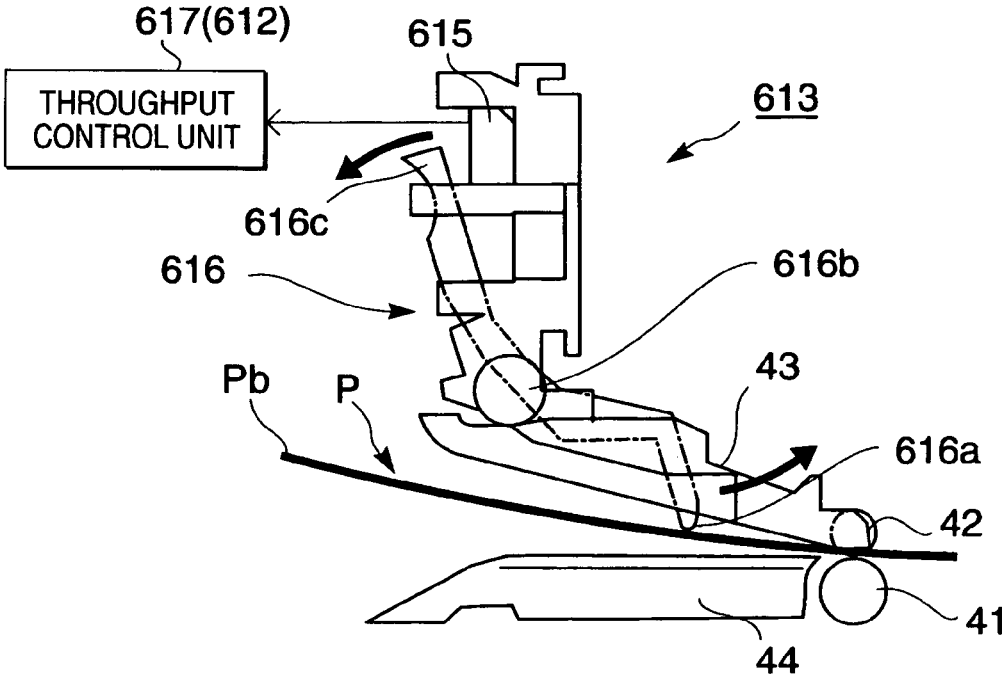

Reference numeral 613 shown in FIGS. 17A and 17B denotes a recording material detector, and a detection lever member 616 rotates with a fulcrum 616*b* as an axis while being urged by a spring not shown). This detection lever member 616 has a recording paper abutment portion 616*a* provided at one end thereof for abutting against the recording paper P, as well as a shielding portion 616C provided on the other end thereof for shielding the light received by a detecting sensor unit 615.

The recording paper P is fed in the state shown in FIG. 17A, and the recording paper P abuts against the recording paper abutment portion 616*a*, and pushes the recording paper abutment portion 616*a* upward. Accordingly, since the detection lever member 616 rotates with the fulcrum 616*b* as an axis, the shielding potion 616C is dislocated from the detecting sensor unit 615. Namely, as the detecting sensor unit 615 detects the light, it is possible to detect the presence or absence of the recording paper P. In other words, it is possible to reliably detect the leading end of the recording paper P or the rear end Pb.

When a signal obtained by such a recording material detector 613 is received by a throughput control unit 617, and the rear end Pb of the recording paper P is fed from the hopper 23 to the downstream side, control can be provided such that the second guide member 606 slides from the second position 605 to the first position 604. Namely, regardless of whether or not recording is being effected, when the rear end Pb of the recording paper P is fed from the hopper 23 to the downstream side, the second guide member 606 can be returned to the first position 604 to prepare for the feeding of the ensuing recording paper P. In other words, since the second guide member 606 is returned to the first position 604 at an early timing, it is possible to improve the throughput.

In addition, since the second guide member 606 is returned at an early timing, the moving speed of the second guide member 606 can also be slowed down within a range which does not cause a decline in the throughput. Namely, the operating noise can be made quiet by slowing down the moving speed.

In addition, the recording material guiding device 601 in accordance with this embodiment has an unskewing means 619 (FIG. 13) which includes the paper feed roller 21 disposed in such a manner as to be offset toward the first side end guiding member 24*a*, as well as the transport drive roller 41 and the transport driven rollers 42 serving as the "transport rollers" extending in the main scanning direction on the downstream in the transporting direction of the paper feed roller and forwardly and reversely rotatable to transport the recording paper P, and which unskews the recording paper P before feeding by means of the paper feed roller 21, the transport drive roller 41, and the transport driven rollers 42.

Since the paper feed roller 21 is disposed in such a manner as to be offset toward the first side end guide member side, as the feeding progresses, the frictional resistance on the second side end guide member side at the side end of the recording paper P becomes greater than the frictional resistance on the first side end guide member side. Accordingly, the leading end of the recording paper P skews toward the opposite side of the first side end guide member side. Then, after the leading end of the recording paper in the skewed state has been fed slightly in the feeding direction by the transport drive roller 41, the transport drive roller 41 is reversely rotated until the state of engagement of the leading end of the recording paper P with the transport drive roller 41 is canceled. Thereupon, since the rotation of the paper feed roller 21 in the opposite direction is restricted, the recording paper P assumes a slightly deflected state in which the paper feed roller 21 lightly grips the recording paper P. Namely, the leading end of the recording paper P assumes a state of abutting in the main scanning direction at the nip line formed in the main scanning direction by the transport drive roller 41 and the transport driven rollers 42.

At this time, the recording paper P slips with respect to the paper feed roller 21 by the returning force of the deflection, so that the side end (opposite side to Pa) of the recording paper P moves away from the first side end guide member 24*a*.

In other words, the recording paper P can be moved slightly toward the opposite side to the first side end guide member side, i.e., toward the second side end guide member side. Accordingly, since a gap (not shown) is produced between the side end (opposite side to Pa) of the recording paper P and the first side end guide member 24*a*, it is possible to prevent frictional contact, As a result, during recording, it is possible to prevent the frictional contact of the recording paper P on both sides of the first side end guide member 24*a* and the second side end guide member 25*a*.

Second Embodiment

As described above, even in a case where the second guide member 606 is returned from the second position 605 to the first position 604, there is a possibility that the side ends Pa of the randomly oriented sheets of recording paper P fail to be arranged neatly.

Accordingly, the recording material guiding device in accordance with a second embodiment of the invention is so constructed as to arrange the side ends Pa neatly by pushing in the side ends Pa of the sheets of recording paper P by sliding the second guide member 606 slightly toward the recording paper side away from the first position 604.

Figure 18A:
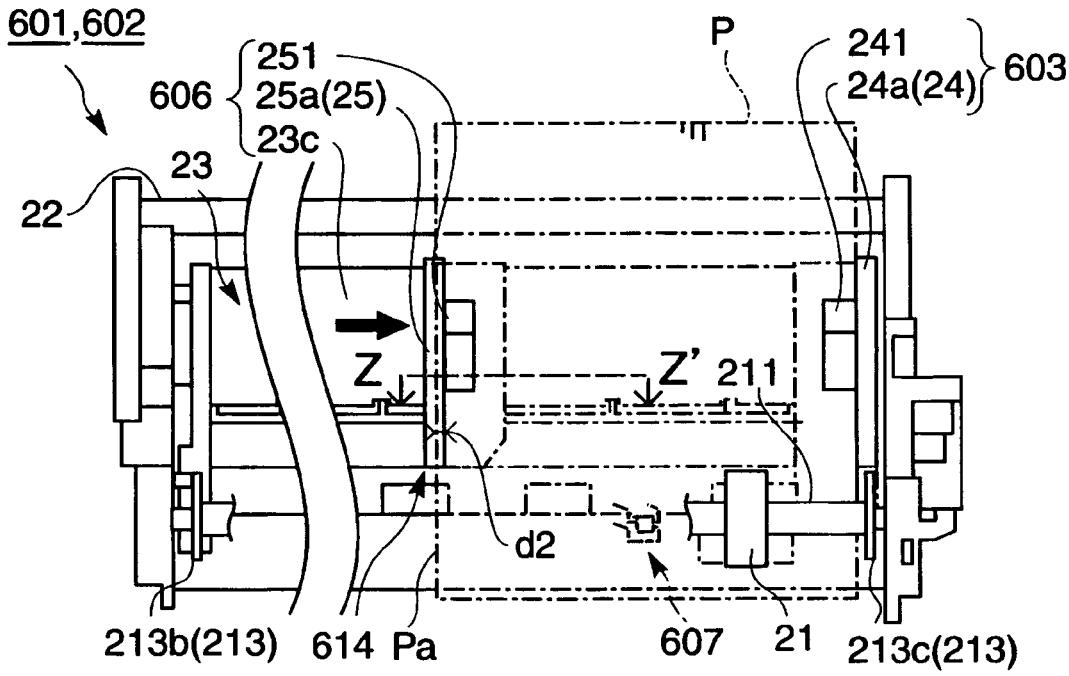
FIG. 18A is a plan view illustrating another embodiment.
Figure 18B:
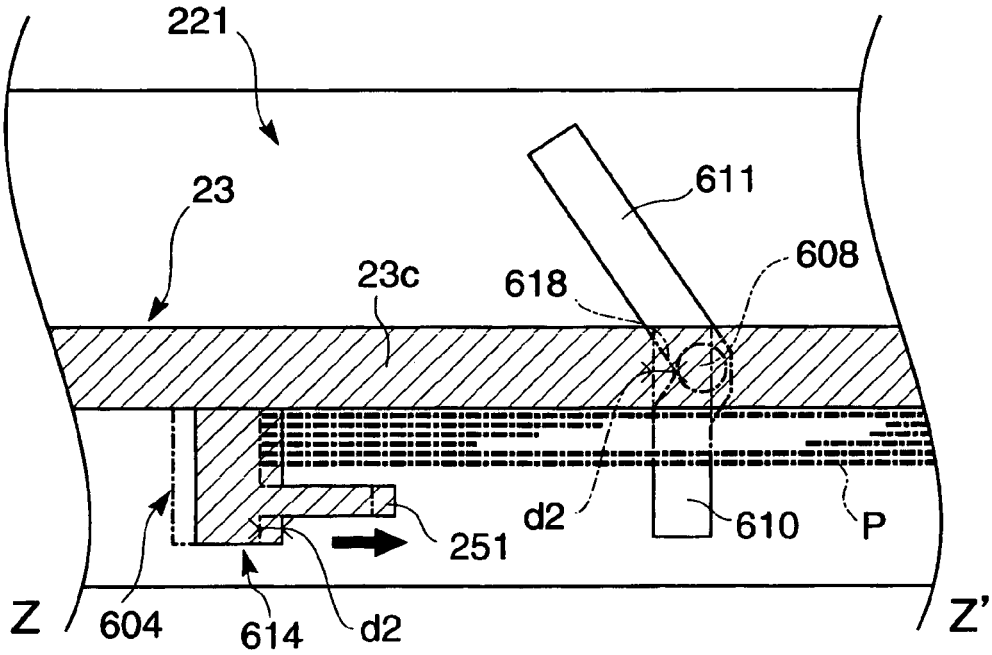
FIG. 18B is a cross-sectional view of essential portions shown in FIG. 18A.

FIGS. 18A and 18B show states in which the second guide member 606 is at a third position 614, in which FIG. 18A is a plan view thereof, and FIG. 18B is a cross-sectional view, taken along line Z-Z' in FIG. 18A, of essential portions of the moving direction converting mechanism 607.

The second guide member 606 in accordance with the second embodiment is arranged to slide to the third position 614 after sliding to the second position 605. The third position 614 is a position which is slightly displaced a distance d2 from the first position 604 toward the recording paper side.

As for a specific method of sliding to the third position 614, an inverse chevron-shaped inclined portion 618 which is inclined toward mutually different directions is provided between the rectilinear portion 610 and the inclined portion 611 of the guide groove 609, as shown in FIG. 18B. Here, the apex of the inverse chevron-shaped inclined portion 618 is arranged to project the distance d2 from the rectilinear portion 610 toward the first guide member side in the main scanning direction. As a result, the second guide member 606 can be slid to the third position 614 while sliding from the second position 605 to the first position 604 in conjunction with the swinging movement of the hopper 23.

Here, reference numeral 614 shown in FIG. 13B denotes the third position, which is displaced the distance d2 from the first position 604 shown by the chain line toward the recording paper side.

Consequently, even in the case where the side ends Pa of the stacked sheets of recording paper P are randomly oriented at the second position 605, the second guide member 606 slides to the third position 614, thereby making it possible to neatly arrange the side ends Pa of the randomly oriented sheets of recording paper P by pushing them in.

It should be noted that, in the present invention, although the gap d1 is provided with respect to the side ends Pa by sliding only the second guide member 606 on one side to prevent the frictional contact, it goes without saying that it is possible to provide the gap d1 with respect to the side ends of the recording paper P by sliding both sides, i.e., both the first guide member 603 and the second guide member 606 to completely set the frictional contact to zero.

In addition, the present invention is not limited to the foregoing embodiments, and it goes without saying that various modifications are possible within the scope of the invention recited in the claims, and that such modifications are also included in the scope of the invention.

What is claimed is:

1. A recording material guiding device comprising:

a feed tray in which a recording material is stacked;

a first side end guiding member and a second side end guide member for restricting the movement of the recoding material in a main scanning direction; and a hopper having the first side end guiding member and the second side end guide member and capable of causing the stacked recording material to be brought into contact with and move away from a feed roller so as to transport the stacked recording material to the feed roller, wherein the hopper has frictional contact preventing means for preventing frictional contact at least between one side end of the recording material and one of the first side end guiding member and the second side end guide member, wherein the frictional contact preventing means includes:

a first guide member which has the first side end guiding member and whose sliding movement in the main scanning direction is restricted; and a second guide member which has the second side end guide member, and is slidable in the main scanning direction with respect to the first guide member up to a first position and a second position, wherein the first position is a position where the second side end guide member and the one side end of the recording material abut, and the second position is a position for forming a gap between the second side end guide member and the one side end of the recording material, and the frictional contact preventing means has a moving direction converting mechanism for converting a force for causing the hopper to be brought into contact with and move away from the feed roller into a force for causing the second guide member to slide in the main scanning direction;

the moving direction converting mechanism has a guide projection provided on the second guide member and a guide groove provided in the feed tray and adapted to engage the guide projection; and the guide groove includes:

a rectilinear portion provided on a side of the feed roller and extending in the same direction as a direction in which the hopper is brought into contact with and moves away from the feed roller; and an inclined portion provided on a side away from the feed roller and inclined with respect to the rectilinear portion.

2. A recording material guiding device comprising:

a feed tray in which a recording material is stacked;

a first side end guiding member and a second side end guide member for restricting the movement of the recoding material in a main scanning direction; and a hopper having the first side end guiding member and the second side end guide member and capable of causing the stacked recording material to be brought into contact with and move away from a feed roller so as to transport the stacked recording material to the feed roller, wherein the hopper has frictional contact preventing means for preventing frictional contact at least between one side end of the recording material and one of the first side end guiding member and the second side end guide member, wherein the frictional contact preventing means includes:

a first guide member which has the first side end guiding member and whose sliding movement in the main scanning direction is restricted; and a second guide member which has the second side end guide member, and is slidable in the main scanning direction with respect to the first guide member up to a first position and a second position, wherein the first position is a position where the second side end guide member and the one side end of the recording material abut, and the second position is a position for forming a gap between the second side end guide member and the one side end of the recording material, and the frictional contact preventing means has a moving direction converting mechanism for converting a force for causing the hopper to be brought into contact with and move away from the feed roller into a force for causing the second guide member to slide in the main scanning direction;

wherein the second guide member has a guide member control portion for providing control such that when the second guide member is at the second position, the second guide member slides from the second position to the first position until ensuing recording material to be recorded is fed; and the guide member control portion has a throughput control unit which provides control such that when a rear end in a transporting direction of the recording material is fed from the hopper to a downstream side, the second guide member slides from the second position to the first position.

3. The recording material guiding device according to claim 2, wherein the throughput control unit has a recording material detector provided on the downstream side of the hopper to detect the rear end of the recording material.

4. A recording material guiding device comprising:

a feed tray in which a recording material is stacked;

a first side end guiding member and a second side end guide member for restricting the movement of the recoding material in a main scanning direction;

a cam disposed coaxially with the feed roller to control the hopper, the cam is provided with a projection which extends at least a length from the first position to the second position in the main scanning direction so as to abut against the second abutment portion at the second position; and a hopper having the first side end guiding member and the second side end guide member and capable of causing the stacked recording material to be brought into contact with and move away from a feed roller so as to transport the stacked recording material to the feed roller; and wherein the hopper has frictional contact preventing means for preventing frictional contact at least between one side end of the recording material and one of the first side end guiding member and the second side end guide member, wherein the frictional contact preventing means includes:

a first guide member which has the first side end guiding member and whose sliding movement in the main scanning direction is restricted; and a second guide member which has the second side end guide member, and is slidable in the main scanning direction with respect to the first guide member up to a first position and a second position, wherein the first position is a position where the second side end guide member and the one side end of the recording material abut, and the second position is a position for forming a gap between the second side end guide member and the one side end of the recording material, and the frictional contact preventing means has a moving direction converting mechanism for converting a force for causing the hopper to be brought into contact with and move away from the feed roller into a force for causing the second guide member to slide in the main scanning direction.

5. A recording material guiding device comprising:

a feed tray in which a recording material is stacked;

a first side end guiding member and a second side end guide member for restricting the movement of the recoding material in a main scanning direction;

a liftup preventing guide disposed on the second side end guide member and adapted to prevent the lifting up of the stacked recording material, the liftup preventing guide extends at least the length from the first position to the second position in the main scanning direction so as to be capable of abutting against a surface of the stacked recording material even if the second guide member is at the second position; and a hopper having the first side end guiding member and the second side end guide member and capable of causing the stacked recording material to be brought into contact with and move away from a feed roller so as to transport the stacked recording material to the feed roller, wherein the hopper has frictional contact preventing means for preventing frictional contact at least between one side end of the recording material and one of the first side end guiding member and the second side end guide member, wherein the frictional contact preventing means includes:

a first guide member which has the first side end guiding member and whose sliding movement in the main scanning direction is restricted; and a second guide member which has the second side end guide member, and is slidable in the main scanning direction with respect to the first guide member up to a first position and a second position, wherein the first position is a position where the second side end guide member and the one side end of the recording material abut, and the second position is a position for forming a gap between the second side end guide member and the one side end of the recording material, and the frictional contact preventing means has a moving direction converting mechanism for converting a force for causing the hopper to be brought into contact with and move away from the feed roller into a force for causing the second guide member to slide in the main scanning direction.

6. A recording material guiding device comprising:

a feed tray in which a recording material is stacked;

a first side end guiding member and a second side end guide member for restricting the movement of the recoding material in a main scanning direction; and a hopper having the first side end guiding member and the second side end guide member and capable of causing the stacked recording material to be brought into contact with and move away from a feed roller so as to transport the stacked recording material to the feed roller, wherein the hopper has frictional contact preventing means for preventing frictional contact at least between one side end of the recording material and one of the first side end guiding member and the second side end guide member, wherein the frictional contact preventing means includes:

a first guide member which has the first side end guiding member and whose sliding movement in the main scanning direction is restricted; and a second guide member which has the second side end guide member, and is slidable in the main scanning direction with respect to the first guide member up to a first position and a second position, wherein the first position is a position where the second side end guide member and the one side end of the recording material abut, and the second position is a position for forming a gap between the second side end guide member and the one side end of the recording material, and the frictional contact preventing means has a moving direction converting mechanism for converting a force for causing the hopper to be brought into contact with and move away from the feed roller into a force for causing the second guide member to slide in the main scanning direction; and the second guide member is arranged to slide to a third position after sliding to the second position, and the third position is a position which is displaced slightly from the first position toward a side of the recording material.

7. A recording material guiding device comprising:

a feed tray in which a recording material is stacked;

a first side end guiding member and a second side end guide member for restricting the movement of the recoding material in a main scanning direction; and a hopper having the first side end guiding member and the second side end guide member and capable of causing the stacked recording material to be brought into contact with and move away from a feed roller so as to transport the stacked recording material to the feed roller, and the feed roller is disposed in such a manner as to be offset toward the first side end guiding member, wherein the hopper has frictional contact preventing means for preventing frictional contact at least between one side end of the recording material and one of the first side end guiding member and the second side end guide member, wherein the frictional contact preventing means includes:

a first guide member which has the first side end guiding member and whose sliding movement in the main scanning direction is restricted; and a second guide member which has the second side end guide member, and is slidable in the main scanning direction with respect to the first guide member up to a first position and a second position, wherein the first position is a position where the second side end guide member and the one side end of the recording material abut, and the second position is a position for forming a gap between the second side end guide member and the one side end of the recording material, and the frictional contact preventing means has a moving direction converting mechanism for converting a force for causing the hopper to be brought into contact with and move away from the feed roller into a force for causing the second guide member to slide in the main scanning direction; and the recording material guiding device further comprising:

a transport roller extending in the main scanning direction on the downstream side in the transporting direction of the feed roller and forwardly and reversely rotatable to transport the recording material; and unskewing means which unskews the recording material before feeding by means of the feed roller and the transport roller.

8. A recording apparatus comprising:

a feeding section for feeding a stacked recording material by holding the stacked recording material;

a recording section for effecting recording on the recording material fed from the feeding section; and a discharge section for discharging the recording material from the recording section, wherein the feeding section has the recording material guiding device according to any one of claims 1, 2, 4, 7.

* * * * *